US011235325B2

(12) United States Patent
Roberts et al.

(10) Patent No.: US 11,235,325 B2
(45) Date of Patent: Feb. 1, 2022

(54) MICROFLUIDIC SYSTEM INCLUDING REMOTE HEAT SPREADER

(71) Applicant: Sharp Life Science (EU) Limited, Oxford (GB)

(72) Inventors: Philip Mark Shryane Roberts, Oxford (GB); Adam Christopher Nightingale, Oxford (GB)

(73) Assignee: Sharp Life Science (EU) Limited, Oxford (GB)

( * ) Notice: Subject to any disclaimer, the term of this patent is extended or adjusted under 35 U.S.C. 154(b) by 331 days.

(21) Appl. No.: 16/680,042

(22) Filed: Nov. 11, 2019

(65) Prior Publication Data

US 2021/0138457 A1 May 13, 2021

(51) Int. Cl.
*B01L 3/00* (2006.01)

(52) U.S. Cl.
CPC ..... *B01L 3/50273* (2013.01); *B01L 2300/043* (2013.01); *B01L 2300/0609* (2013.01); *B01L 2300/0663* (2013.01); *B01L 2300/1805* (2013.01); *B01L 2400/0427* (2013.01)

(58) Field of Classification Search
CPC ..... B01L 3/50273; B01L 2300/043; B01L 2300/0609; B01L 2300/0663; B01L 2300/1805; B01L 2400/0427; B01L 3/502792; B01L 2200/0673; B01L 2300/046; B01L 2300/1822; B01L 2300/1827; B01L 7/525
See application file for complete search history.

(56) References Cited

U.S. PATENT DOCUMENTS

| | | | |
|---|---|---|---|
| 6,565,727 | B1 | 5/2003 | Shenderov |
| 6,911,132 | B2 | 6/2005 | Pamula et al. |
| 7,163,612 | B2 | 1/2007 | Sterling et al. |

(Continued)

FOREIGN PATENT DOCUMENTS

| | | |
|---|---|---|
| EP | 3357576 | 8/2018 |
| WO | WO 0146688 | 6/2001 |
| WO | WO 2015/020963 | 2/2015 |

*Primary Examiner* — Jennifer Wecker
*Assistant Examiner* — Oyeleye Alexander Alabi
(74) *Attorney, Agent, or Firm* — Renner, Otto, Boisselle & Sklar, LLP

(57) ABSTRACT

A microfluidic control system for controlling an EWOD device has an enhanced thermal control system for generating a temperature profile within an EWOD device that is inserted into the microfluidic control system. The microfluidic control system includes a housing that defines an aperture for receiving an EWOD device; an active heating component located within the housing at a base of the aperture; and a lid attached to the housing that is moveable between a closed position and an open position, the lid including a thermal control component. When the lid is in the closed position, the thermal control component is positioned at the aperture and aligned oppositely from the active heating component. The active heating component may include a plurality of independently controllable individual heating elements, and the thermal control component may include a respective plurality of individual thermal control elements. The microfluidic control system further may include a clamp positioned between the lid and the housing for retaining the EWOD device.

18 Claims, 13 Drawing Sheets

(56) References Cited

U.S. PATENT DOCUMENTS

| | | | | |
|---|---|---|---|---|
| 8,263,392 | B2 | 9/2012 | Gale et al. | |
| 8,900,811 | B2 | 12/2014 | Sundberg et al. | |
| 2004/0005720 | A1 | 1/2004 | Cremer et al. | |
| 2004/0151629 | A1 | 8/2004 | Pease et al. | |
| 2009/0145576 | A1 | 6/2009 | Wyrick et al. | |
| 2010/0323405 | A1 | 12/2010 | Pollack et al. | |
| 2013/0137144 | A1 | 5/2013 | Chu et al. | |
| 2013/0175169 | A1* | 7/2013 | Feiglin | B01L 3/502792 204/450 |
| 2015/0140562 | A1 | 5/2015 | Conoc et al. | |
| 2015/0251184 | A1 | 9/2015 | Watanabe et al. | |
| 2016/0129437 | A1 | 5/2016 | Kayyem et al. | |

* cited by examiner

MICROFLUIDIC SYSTEM INCLUDING REMOTE HEAT SPREADER

TECHNICAL FIELD

The present invention relates to a system for controlling a digital microfluidic device, and more specifically to a microfluidic device control system for effective control of a temperature profile in an active matrix electro-wetting on dielectric (AM-EWOD) digital microfluidic device.

BACKGROUND ART

Electro-wetting on dielectric (EWOD) is a well-known technique for manipulating droplets of fluid by application of an electric field. Active Matrix EWOD (AM-EWOD) refers to implementation of EWOD in an active matrix array incorporating transistors, for example by using thin film transistors (TFTs). EWOD (or AM-EWOD) is thus a candidate technology for digital microfluidics for lab-on-a-chip technology.

FIG. 1A is a drawing depicting an exemplary EWOD based microfluidic system. In the example of FIG. 1, the microfluidic system includes a reader 8 and a cartridge 9. The cartridge 9 may contain a microfluidic device, such as an AM-EWOD device 10, as well as (not shown) fluid input ports into the device and an electrical connection as are conventional. The fluid input ports may perform the function of inputting fluid into the AM-EWOD device 10 and generating droplets within the device, for example by dispensing from input reservoirs as controlled by electrowetting. The microfluidic device includes an electrode array configured to receive the inputted fluid droplets.

The microfluidic system further may include a control system configured to control actuation voltages applied to the electrode array of the microfluidic device to perform manipulation operations to the fluid droplets. For example, the reader 8 may contain such a control system configured as control electronics 11 and a storage device 12 that may store any application software and any data associated with the system. The control electronics 11 may include suitable circuitry and/or processing devices that are configured to carry out various control operations relating to control of the AM-EWOD device 10, such as a CPU, microcontroller or microprocessor, and the storage device 11 may be any suitable computer-based memory device.

In the example of FIG. 1A, an external sensor module 13 is provided for sensing droplet properties. For example, optical sensors as are known in the art may be employed as external sensors for sensing droplet properties, which may be incorporated into a probe that can be located in proximity to the EWOD device. Suitable optical sensors include camera devices, light sensors, charged coupled devices (CCD) and similar image sensors, and the like. A sensor additionally or alternatively may be configured as internal sensor circuitry incorporated as part of the drive circuitry in each array element. Such sensor circuitry may sense droplet properties by the detection of an electrical property at the array element, such as impedance or capacitance.

FIG. 1B is a drawing depicting a portion of a conventional EWOD device in cross section, such as may be used as the AM-EWOD device 10 in FIG. 1A. The device includes a lower substrate 72, the uppermost layer of which is formed from a conductive material which is patterned so that a plurality of electrodes 38 (e.g., 38A and 38B in FIG. 1B) are realized. The electrode of a given array element may be termed the element electrode 38. The liquid droplet 4, including a polar material (which is commonly also aqueous and/or ionic), is constrained in a plane between the lower substrate 72 and a top substrate 36. A suitable fluid gap between the two substrates may be realized by means of a spacer 32 and a non-polar fluid 34 (e.g. a filler fluid, or oil) may be used within the fluid gap to occupy the volume not occupied by the liquid droplet 4. Alternatively, and optionally, the volume not occupied by the liquid droplet could be filled with air or another gas. An insulator layer 20 disposed upon the lower substrate 72 separates the conductive element electrodes 38A, 38B from a first hydrophobic coating 16 upon which the liquid droplet 4 sits with a contact angle 6 represented by 8. The hydrophobic coating is formed from a hydrophobic material (commonly, but not necessarily, a fluoropolymer). On the top substrate 36 is a second hydrophobic coating 26 with which the liquid droplet 4 may come into contact. Interposed between the top substrate 36 and the second hydrophobic coating 26 is a reference electrode 28.

Examples of EWOD devices include the following. U.S. Pat. No. 6,565,727 (Shenderov, issued May 20, 2003) discloses a passive matrix EWOD device for moving droplets through an array. U.S. Pat. No. 6,911,132 (Pamula et al., issued Jun. 28, 2005) discloses a two-dimensional EWOD array to control the position and movement of droplets in two dimensions. U.S. Pat. No. 7,163,612 (Sterling et al., issued Jan. 16, 2007) describes how TFT based thin film electronics may be used to control the addressing of voltage pulses to an EWOD array by using circuit arrangements very similar to those employed in active matrix display technologies.

Many applications of EWOD technology require that the temperature of the device be controlled and/or selectively varied to cause the temperature of the droplets within the device to reach a desired value. Example applications requiring precise control of droplet temperature include molecular diagnostics, material synthesis, and nucleic acid amplification. A number of approaches have been taken to provide temperature control in a microfluidic device. One approach is to control the temperature of the entire device and the device housing by using an external heating device, for example a hot plate. Such a heating device can be used to heat the whole device to a particular temperature, or the heating device can be used to create a temporal temperature gradient as the device is heated up or cooled down. This approach, however, suffers from a disadvantage that the rates of temperature change that can be achieved are generally low, thereby limiting the temperature gradient that the droplets experience. Other approaches use spatial temperature gradients, whereby the temperature of a droplet is set by the location of the droplet within a region of the device in which the spatial temperature gradient is defined. Examples of the use of such heating devices include the following.

US 2009/0145576 A1 (Wyrick et al., published Jun. 11, 2009) discloses an actively temperature regulated microfluidic chip assembly including embodiments for defining a spatial temperature gradient between two temperature regulating elements.

US 2004/0005720 (Cremer et al., published Jan. 8, 2004) discloses an apparatus for providing a temperature gradient to an architecture suitable for parallel chemical or biochemical processing. The apparatus uses two temperature elements disposed essentially parallel to each other and in thermal contact with the device substrate. When the temperature elements are held at different temperatures, a temperature gradient is formed in the substrate. When the distance between the temperature elements is small, an approximately linear temperature gradient can be obtained, but as the distance between the temperature elements increases the temperature gradient becomes increasingly non-linear.

U.S. Pat. No. 8,900,811 B2 (Sundberg et al., issued Dec. 2, 2014) discloses methods and devices that employ microfluidic technology to generate molecular melt curves. Temperature gradients are generated by Joule heating by flowing an electric current through a first and second section of a microchannel, wherein the first cross-section is of a greater size than the second cross-section, which causes the second cross-section to have a higher electrical resistance and therefore a higher temperature than the first cross-section U.S. Pat. No. 8,263,392 B2 (Gale et al., issued Sep. 11, 2012) discloses a device for replicating nucleic acid including a microchannel extending from an inlet port to an outlet port, and a heater for producing a spatial temperature gradient. The temperature gradient is produced by a heater and a cooler, whereby the cooler is either an active device or convective cooling fins.

WO 2015/020963 A1 (Michienzi et al., published Sep. 12, 2015) discloses a microfluidic device with one or more heaters which produce a thermal gradient within the fluidic channel in response to a current flowing through the one or more heaters.

Some of the above methods have been used as part of a nucleic acid analysis assay, such as Polymerase Chain Reaction (PCR), and to perform melt-curve analysis of the molecules under study. PCR is well known as a process that can amplify a single copy or a few copies of a piece of DNA across several orders of magnitude, generating thousands to millions of copies of a particular DNA sequence. Melt-curve analysis is a well-known technique used to determine the temperature at which a double-stranded piece of DNA melts.

Conventional approaches for generating temperature gradients in a microfluidic device have disadvantages for PCR and melt-curve analysis, and for many other chemical and biochemical operations and assays. Such disadvantages include: the complexity of the design and the control methods; the non-linearity of the spatial temperature gradient; the large physical size of the heating apparatus; and the resulting high manufacturing cost. The performance and scope of operation of such devices is therefore limited. Effective heating and temperature gradient formation is an important consideration for "Lab on a Chip" EWOD applications, particularly when the EWOD chip must be disposable based on the nature of the biological or chemical contamination of the surfaces by the reagents and samples that are used.

SUMMARY OF INVENTION

There is a need in the art for an improved temperature control system configuration for controlling a temperature profile within an EWOD device. According to embodiments of the present application, there is provided a system for controlling the operation of an EWOD (or AM-EWOD) device or other microfluidic device within a broader microfluidic system. The microfluidic control system provides a temperature profile within an EWOD device via an enhanced temperature control system. The EWOD device may be configured to move one or more liquid droplets laterally through the EWOD device and hence move the liquid droplet(s) through one or more regions of a defined temperature profile. Such movement through the temperature profile may subject the droplet(s) to a constant temperature profile (that is, a temperature profile that is constant over the path of the droplet(s)), or to a positive or negative temperature gradient. The microfluidic system also may include optical detectors for analyzing samples within the EWOD device, as well as components for fixedly locating the EWOD device within the broader microfluidic control system to ensure correct electrical connection between the microfluidic control system and EWOD device, which aids in ensuring predictable and reproducible operation of the EWOD device.

In exemplary embodiments, the microfluidic control system includes a temperature control system that includes an active heating component and a thermal control component to control a temperature profile of the EWOD device. The thermal control component may be configured as a passive thermal control component that acts as a heat spreader that spreads heat from the active heating component to aid in generating the desired temperature profile across the EWOD device. The thermal control component is attached to an underside of a system lid, and the active heating component is enclosed within a system housing. The thermal control component may be configured as a plurality of individual thermal control elements, and the active heating component may be configured as a plurality of individual heating elements that respectively are aligned with the thermal control elements in use.

The microfluidic control system further may include a clamp that holds an inserted EWOD device in place. In use, when an EWOD device is positioned within the control system housing, generally the lower substrate of the EWOD device makes thermal contact with the active heating component, and an electrical terminal of the EWOD device makes electrical contact with an electrical contact of the microfluidic control system. When the clamp is closed, the clamp applies a compressive pressure to the EWOD device, ensuring the integrity of the electrical connection between the system electrical contact and electrical terminal on the EWOD device. The clamp also may actuate a fluid reservoir within the EWOD device to ensure reliable delivery of a filler fluid or non-ionic liquid into the EWOD channel of the EWOD device. In an embodiment, as the clamp is lowered to a closed position, controlled and selective rupture of sealing cover layers on the fluid reservoir are broken, thereby permitting the fluid to exit the reservoir.

Once the EWOD device is properly positioned and the clamp is closed to secure the EWOD device in place, the lid with the thermal control component is closed over the clamp. The clamp defines an opening through which the thermal control component extends when the lid is in the closed position, such that the thermal control component is in thermal contact with an upper substrate of the EWOD device oppositely from the active heating element. Generally, the thermal control component acts as a heat spreader that distributes heat from the active heating component across the EWOD device, thereby generating a desired temperature profile across the EWOD device.

An aspect of the invention, therefore, is a microfluidic control system for controlling an EWOD device, the control system having an enhanced thermal control system for generating a temperature profile within an EWOD device that is inserted into the microfluidic control system. In exemplary embodiments, the microfluidic control system includes a housing that defines an aperture for receiving an EWOD device; an active heating component located within the housing at a base of the aperture; and a lid attached to the housing that is moveable between a closed position and an open position, the lid including a thermal control component. When the lid is in the closed position, the thermal control component is positioned at the aperture and aligned oppositely from the active heating component. The active heating component may include a plurality of independently controllable individual heating elements, and the thermal control component may include a plurality of individual thermal control elements. A number of individual thermal control elements may equal a number of individual active heating elements, and when the lid is in the closed position, the individual thermal control elements are respectively aligned with the individual active heating elements.

In exemplary embodiments, the microfluidic control system further may include a clamp positioned between the lid and the housing, wherein the clamp is moveable between an open position and a closed position for retaining the EWOD device when the EWOD device is inserted in the aperture and the clamp is in the closed position. The clamp is configured to be closed prior to closure of the lid. When the clamp is in the closed position, the clamp is configured to one or more of: i) press an electrical terminal of the EWOD device to an electrical terminal of the control system located within the housing; ii) correctly orient the EWOD device within the housing; iii) ensure the EWOD device is held proximate to the active heating component; iv) actuate a reservoir of filler fluid integrated on the EWOD device to cause filling of a channel of the EWOD device with filler fluid; and v) present sample receiving ports to a user.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1A:
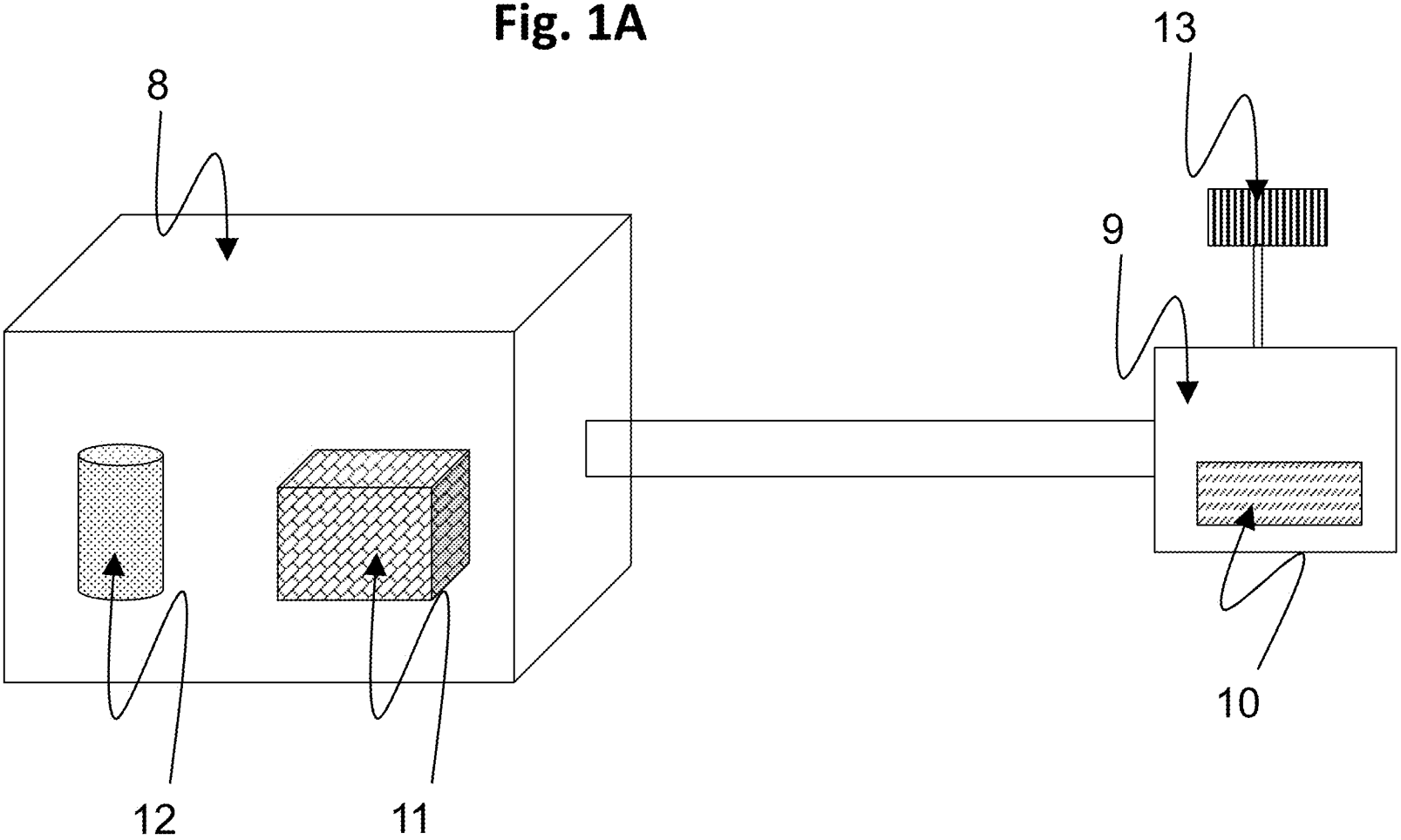
FIG. 1A is a drawing depicting an exemplary EWOD based microfluidic system.

Embodiments of the present invention will now be described with reference to the drawings, wherein like reference numerals are used to refer to like elements throughout. It will be understood that the figures are not necessarily to scale.

Figure 2:
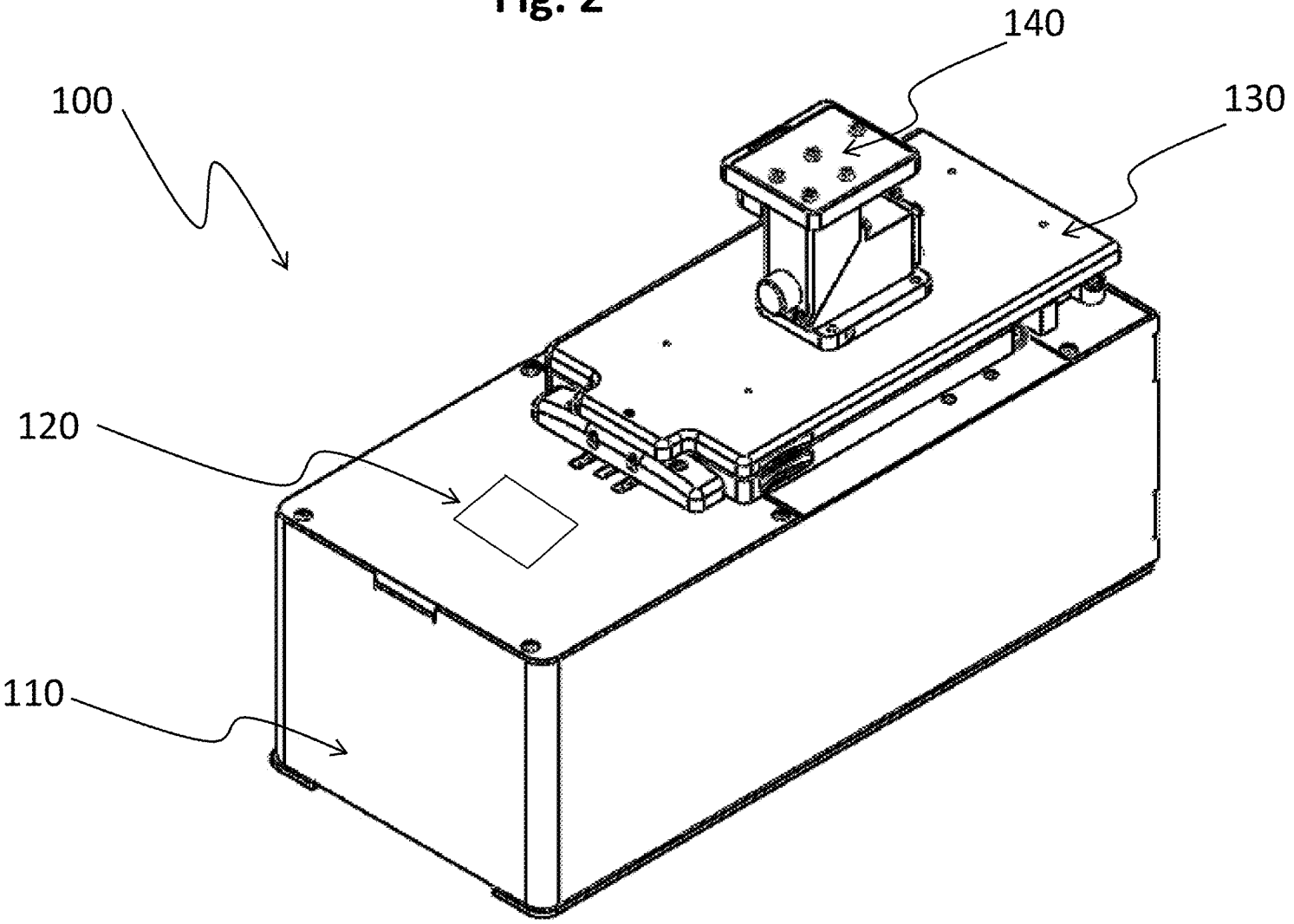
FIG. 2 is a drawing depicting a perspective view of a microfluidic control system in accordance with embodiments of the present application, with the microfluidic control system in a closed position.

FIG. 2 is a drawing illustrating a perspective view of a microfluidic control system 100 in accordance with embodiments of the present application. The control system 100 includes a housing 110, a user interface 120, a lid 130, and an optical system 140. The lid 130 is moveable between an open and a closed position, and the microfluidic control system is illustrated in FIG. 2 with lid 130 in the closed position. The microfluidic system 100 performs the functions of supplying electrical control and power signals to an EWOD device that is inserted into the microfluidic control system as further detailed below, as well as monitoring the progress of processes performed within the EWOD device using the optical system 140. The optical system 140 may include any suitable optical sensors for optically sensing droplets in an EWOD device, such as for example camera devices, light sensors, charged coupled devices (CCD) and similar image sensors, and the like.

The user interface 120 is illustrated in a simple block form, and is configured to receive user inputs that define the parameters of a process to be performed in the EWOD device. It will be appreciated that any suitable user interface components may be employed as are known in the electronic device arts, such as buttons, keypads, touchscreens, and the like. The user interface 120 may also include one or more display devices or other visual indicators that may display messages to a user, including for example results of any processes that have been completed within the EWOD device, any warnings or prompts that require user attention and action, and other information regarding device operation.

The housing 110 and cover 130 may be made of any suitable rigid materials as are commonly used in laboratory instruments. Rigid plastic materials or metals may be used.

Figure 3A:
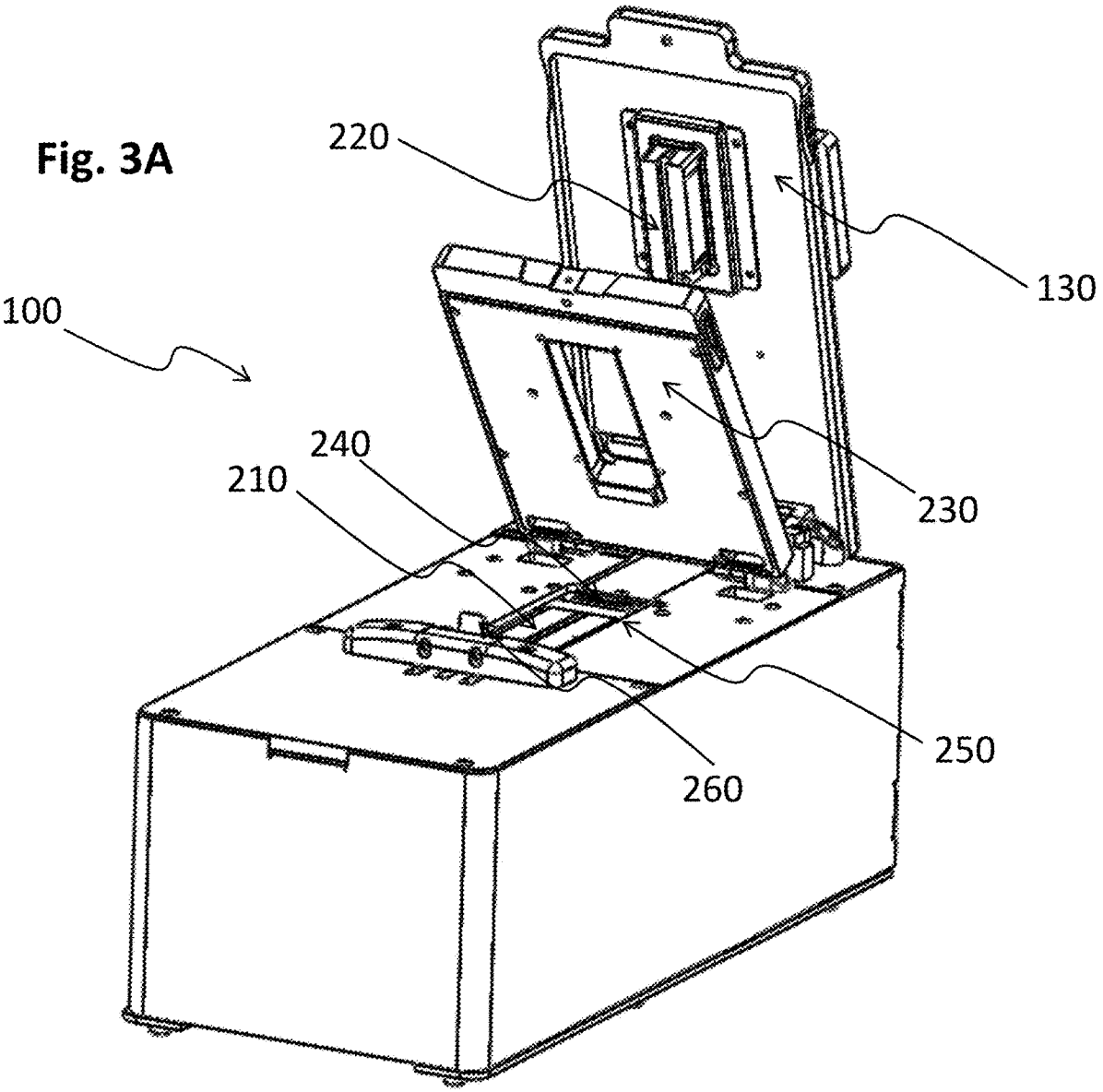
FIG. 3A is a drawing depicting a perspective view of the microfluidic control system of FIG. 2 showing the lid and clamp in an open position and from a front view.
Figure 3B:
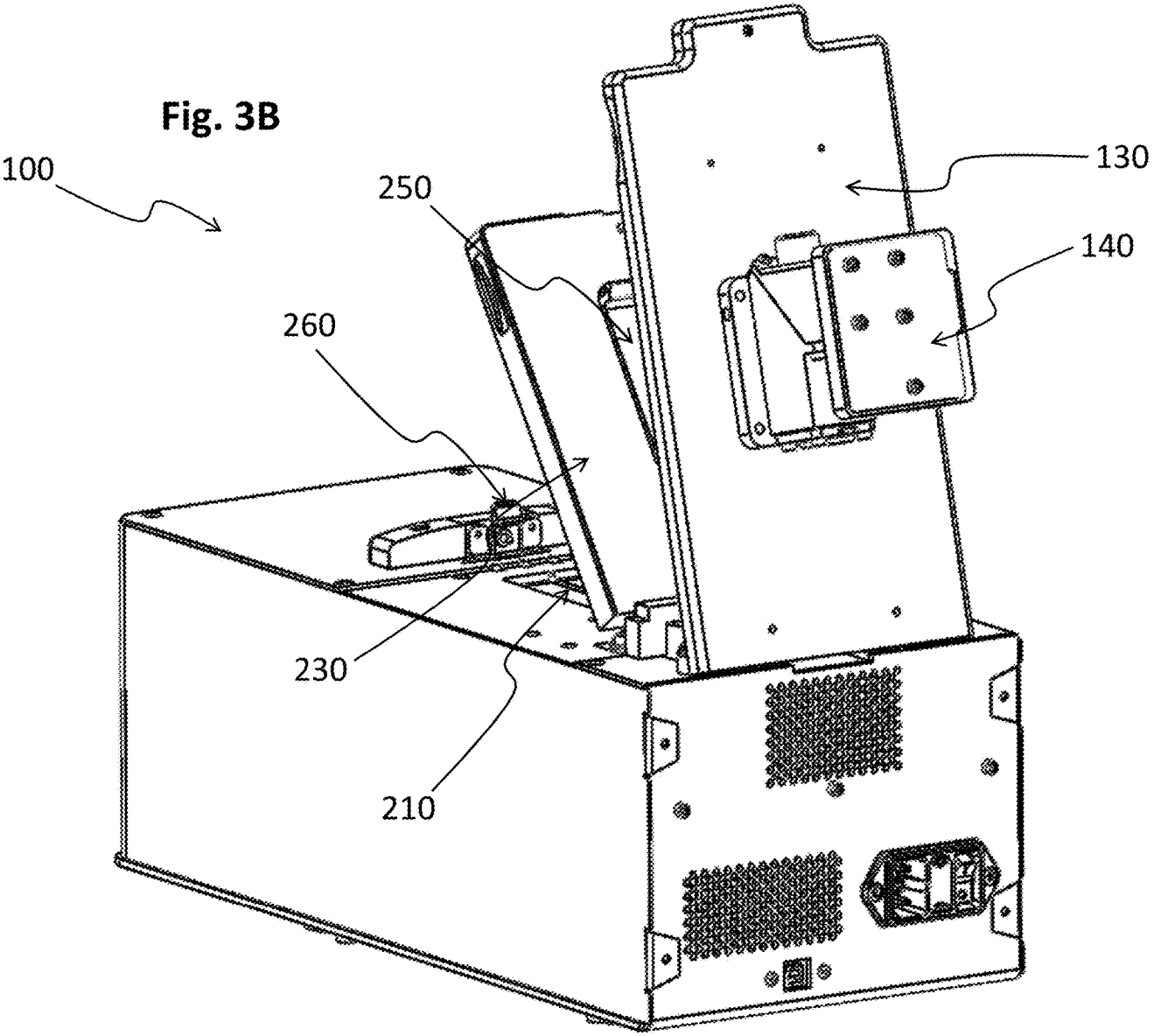
FIG. 3B is a drawing depicting a perspective view of the microfluidic control system of FIG. 2 showing the lid and clamp in an open position and from a rear view.

FIG. 3A is a drawing depicting a perspective view of the microfluidic control system 100 of FIG. 2, showing the lid 130 in an open position and from a front view. FIG. 3B is a drawing depicting a perspective view of the microfluidic control system 100 of FIG. 2 showing the lid 130 in an open position and from a rear view. The open views illustrate additional internal components of the microfluidic control system 100.

To enable the control functions, an electrical connection 240 is provided that provides an electrical connection with an EWOD device that is inserted into the control system so as to permit power and control signals to be supplied to the EWOD device. Optionally, the EWOD device may include sensor elements for sensing the presence or absence of droplets at the element electrodes, or for sensing properties of the liquid droplets, e.g. chemical properties or temperature, as for example described in Applicant's U.S. Pat. No. 8,173,000 issued May 8, 2012 (the contents of which are incorporated herein by reference). When the EWOD device includes sensor elements, the microfluidic control system 100 may also be configured to read output signals generated by the EWOD device. The microfluidic control system 100 may further include components to measure other aspects of the droplet that are pertinent to the assay under test. For example, the optical system 140 may be used to measure optical properties of the liquid droplets such as absorption, reflection or fluorescence. An optical measurement function typically may be used to readout the result of an assay or a biochemical test.

Referring again to the open configurations shown in FIG. 3A and FIG. 3B, the microfluidic control system 100 further may include a temperature control system that includes an active heating component 210 and a thermal control component 220 to control a temperature profile of the EWOD device. In exemplary embodiments, the thermal control component 220 is a passive thermal control component that acts as a heat spreader that spreads heat from the active heating component 210 to aid in generating the desired temperature profile across the EWOD device. The thermal control component is attached to an underside of the lid 130, and the active heating component 210 is enclosed within the housing 110, and more specifically within an aperture 250 defined by the housing 110. The microfluidic control system 100 further may include a clamp 230 that is moveable between an open position (shown in FIGS. 3A and 3B) and a closed position, and in the closed position the clamp 230 holds an inserted EWOD device in place as further detailed below. The EWOD device is placed within the aperture 250 above the active heating component 210 that is located at a base of the aperture.

In use, when an EWOD device is positioned within the aperture 250, generally the lower substrate of the EWOD device makes thermal contact with the active heating component 210, and an electrical terminal of the EWOD device makes electrical contact with electrical contact 240 of the microfluidic control system 100. When clamp 230 is closed, the clamp is locked in place by a latch 260. As the clamp is closed, the clamp applies a compressive pressure to the EWOD device, ensuring the integrity of the electrical connection between electrical contact 240 and electrical terminals on the EWOD device. The clamp 230 also ensures correct alignment of the EWOD device with an internal magnetic actuator (not shown), which may be used to manipulate certain reagents that include magnetically responsive particles that may be used within the EWOD device. The clamp 230 also may actuate a fluid reservoir within the EWOD device to ensure reliable delivery of a filler fluid or non-ionic liquid into the EWOD channel of the EWOD device. These features are discussed in further detail below in connection with figures illustrating the EWOD device as positioned within the microfluidic control system 100.

Once the EWOD device is properly positioned and the clamp 230 is closed, the lid 130 with the thermal control component 220 is closed over the clamp 230. The clamp 230 defines an opening through which the thermal control component 220 extends when the lid 130 is in the closed position, such that the thermal control component is in thermal contact with an upper substrate of the EWOD device oppositely from the active heating component 210. Generally, the thermal control component 220 acts as a heat spreader that distributes heat from the active heating component across the EWOD device, thereby generating a desired temperature profile across the EWOD device. A locking mechanism also may be integrated in lid 130, which comprises a safety lock feature that prevents a user from prematurely raising the lid once an assay protocol within the EWOD device has been initialised. Typically, once lid 130 has been closed an assay sequence may commence within the EWOD device. A user will be informed via user interface 120 when interaction, such as opening the lid, is required. For example, a user may be required to introduce a different fluid into the EWOD device after an initial reaction process has completed, or a user may be prompted to withdraw a processed sample fluid from the EWOD device, which processed fluid may be utilised in another system, such as for example a mass spectrometer or a nucleic acid sequencer.

Certain processes performed within an EWOD device may require specific temperature profiles or specific regions within the channel of the EWOD device to be operated at defined temperatures. The microfluidic control system 100 therefore includes the temperature control system referenced above that includes an active heating component 210 and a thermal control component 220 to control the temperature profile of the EWOD device. The active heating component 210 and the thermal control component 220 may be configured to define discrete thermal zones within the channel of EWOD device. The active heating component 210 may be realized using a range of categories of heating or cooling elements, as will be understood by those skilled in art, including for example resistive (Joule) heaters, Peltier-effect based heaters and/or coolers, optical means of heat generation (e.g. lasers), magnetic type heaters (e.g. conduction), or heaters or coolers based on convective, conductive or radiative transfer of heat into or out of the heating component. In an exemplary embodiment, the active heating component 210 includes a Peltier type element.

The thermal control component 220, which preferably is configured as a passive heat spreader, also may be formed from a range of materials, examples of which include copper, aluminum, gold, silver, platinum, steel, sapphire, or diamond. Typically, thermal control element 220 is selected to have a thermal conductivity of at least about 25 W/m.K, at least about 50 W/m.K, at least about 75 W/m.K, at least about 100 W/m.K, at least about 200 W/m.K, at least about 500 W/m.K, at least about 1000 W/m.K, at least about 2000 W/m.K. The thermal control component may have a width that is at least about 1 mm, at least about 5 mm, at least about 10 mm; at least about 20 mm; a length that is at least about 1 mm, at least about 5 mm, at least about 10 mm, at least about 25 mm, at least about 50 mm, at least about 75 mm, at least about 100 mm; and thickness that is at least about 0.1 mm, at least about 0.5 mm, at least about 1 mm, at least about 2 mm, at least about 5 mm, at least about 10 mm. When the lid 130 of microfluidic control system 100 is closed, the thermal control component 220 is brought into contact with the upper substrate of EWOD device (not shown in FIGS. 3A and 3B). In an exemplary embodiment, the thermal control component 220 instead may be configured as a second active heating component, in which case the thermal control component may be realized utilizing any of the categories of heating and cooling elements described above with respect to the active heating component 210.

Figure 4:
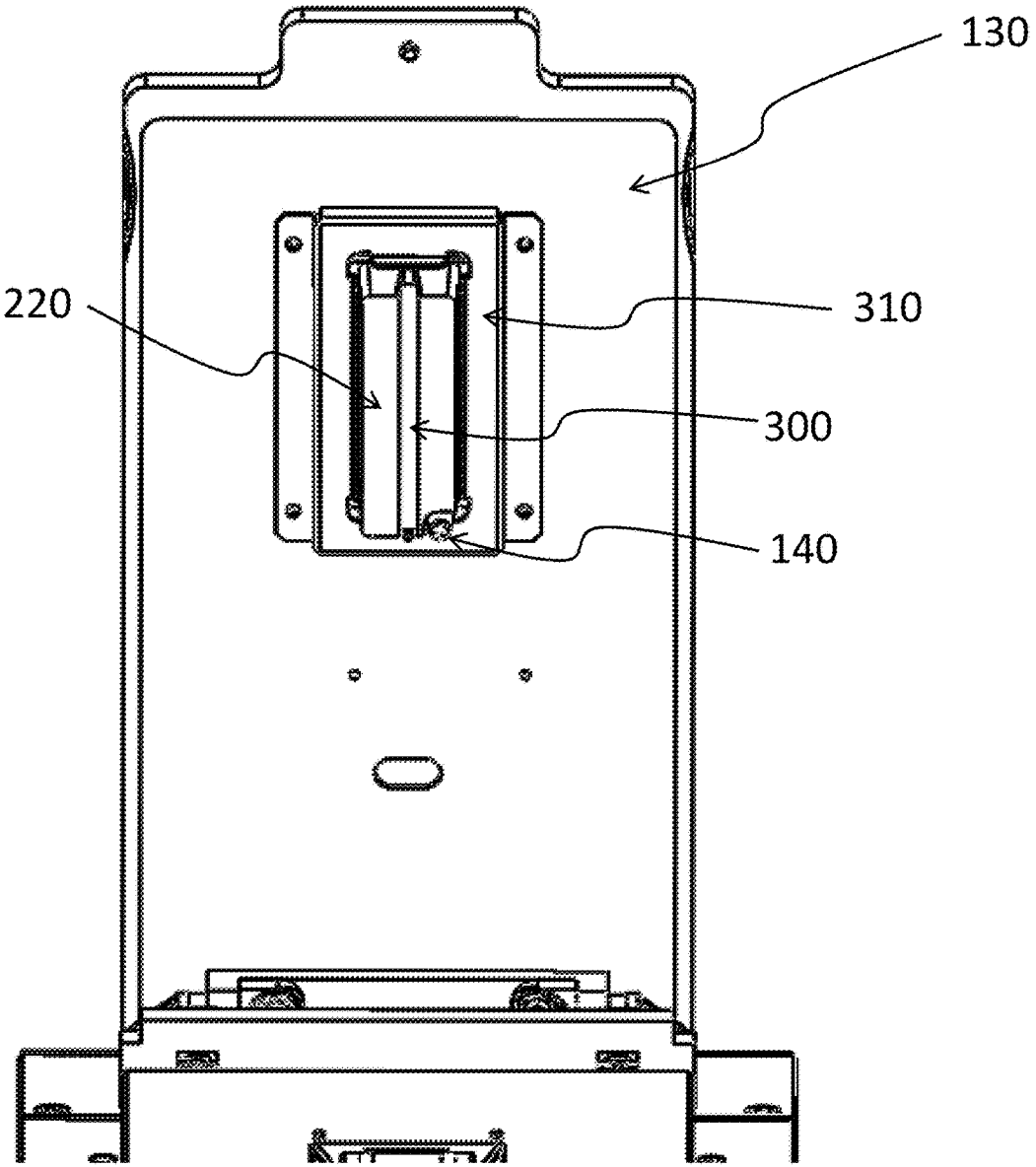
FIG. 4 is a drawing depicting a view of the underside of the lid of the microfluidic control system, which illustrates the thermal control component in combination with an optical system.
Figure 5:
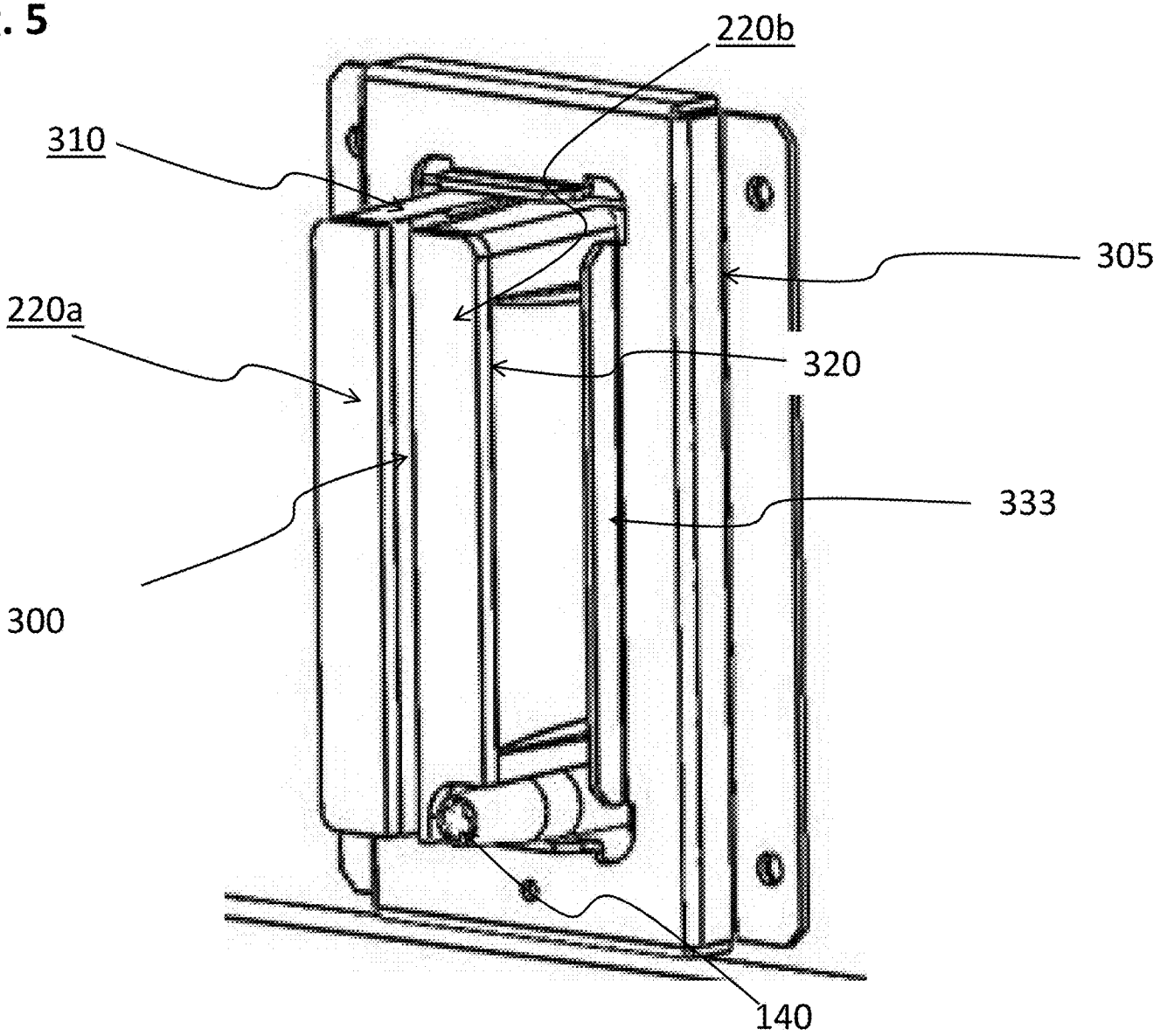
FIG. 5 is a drawing depicting a more close-up view of the thermal control component and optical system including associated mounting features.
Figure 6:
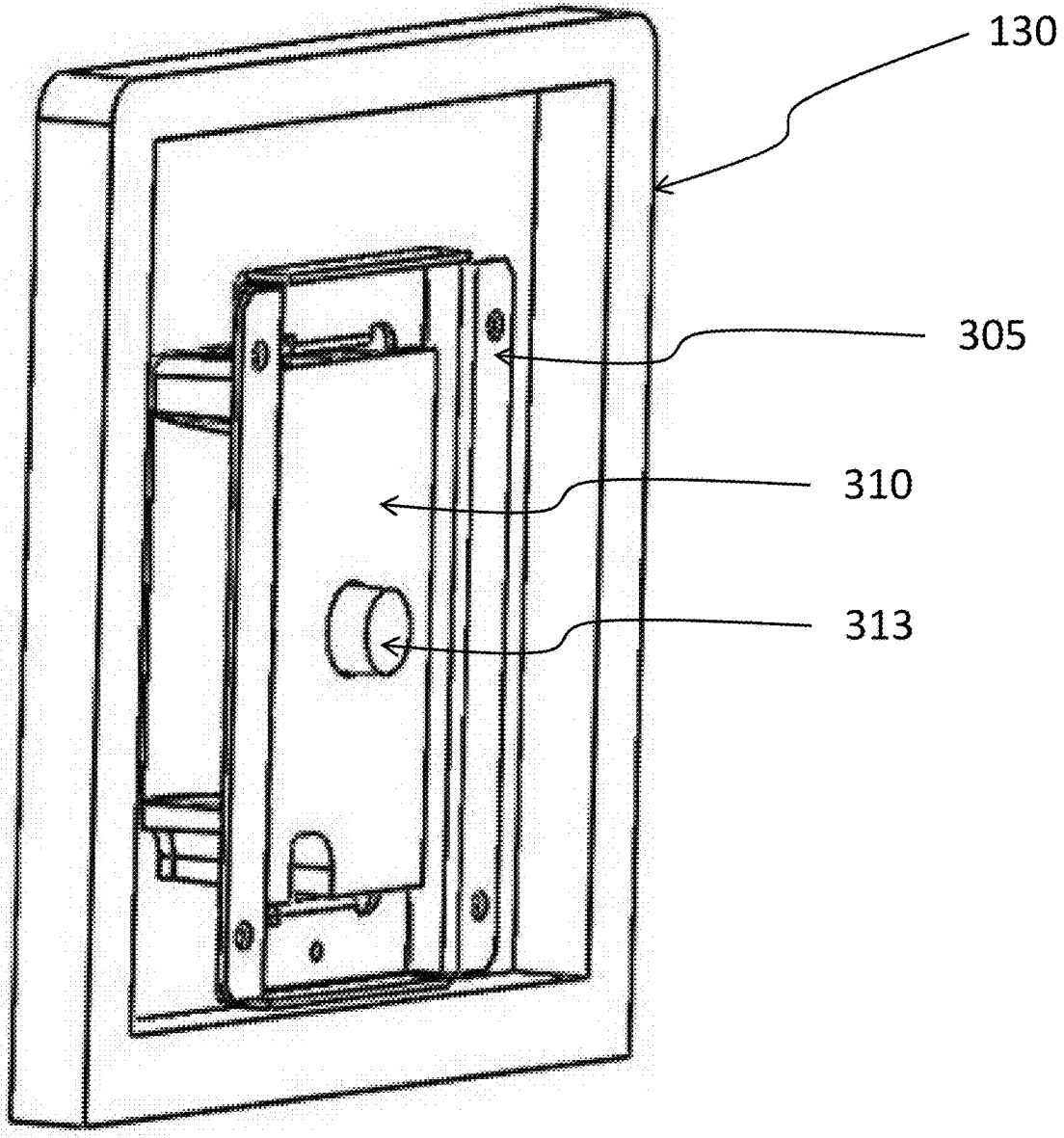
FIG. 6 is a drawing depicting a rear side view of the thermal control mounting features relative to the view of FIG. 5.

FIG. 4 is a drawing depicting a view of the underside of the lid 130 of the microfluidic control system, which illustrates the thermal control component 220 in combination with the underside portion of the optical system 140. FIG. 5 is a drawing depicting a more close-up view of the thermal control component 220 and said portion of the optical system 140, including associated mounting features for mounting the thermal control component to the lid 130. FIG. 6 is a drawing depicting a rear side view of the lid 130 relative to the view of FIG. 5 and showing the thermal control mounting features. In exemplary embodiments (as illustrated most particularly in FIG. 5), the thermal control component 220 includes a plurality of independent individual thermal control elements. In this particular example, the thermal control component 220 includes two independent individual thermal control elements 220*a* and 220*b*. The thermal control elements 220*a* and 220*b* are configured as dual rectangular heat spreaders that run along the longitudinal direction of the lid 130. It will be appreciated that any suitable number and/or shape of individual thermal control elements may be employed.

The thermal control component including the plurality of individual thermal control elements may be mounted on a multi-axis mounting 310 that is secured to the lid 130 using a support bracket 305. By multi-axis mounting, it is meant that the mounting 310 extends three dimensionally from the underside of the lid 130 when in the assembled state with the bracket 305 holding the mounting 310 in place. The support bracket 305 may include multiple fastening holes (e.g., four screw holes in this example) for mounting to an underside of the lid 130. The support bracket 305 defines an opening that is surrounded by one or more flanges 333 through which the multi-axis mounting 310 protrudes. The multi-axis mounting 310 has a tapered profile such that the dimensions around the mounting perimeter at thermal control elements 220*a* and 220*b* is smaller than the perimeter at the opposite end adjacent to the mounting bracket 305. The flanges 333 surround a portion of multi-axis mounting 310, which sits above bracket 305, and the tapered configuration prevents the mounting 310 from passing completely through the bracket 305 particularly during assembly. The tapered profile further facilitates the rotational insertion of the thermal control elements 220*a* and 220*b* into the opening of the EWOD device when the lid 130 is closed.

A biasing layer 320 may be provided between the thermal control component 220 and the multi-axis mounting 310. In this example, the biasing layer is configured as individual biasing elements commensurately with the individual thermal control elements 220*a* and 220*b*. The biasing layer 320 may be made of any suitable resilient material or element, such as a spring, an elastomeric pad, or a resilient foam pad. The multi-axis mounting 310 and biasing layer 320 ensure that the surface of the thermal control component 220 is accurately located against the upper substrate of an EWOD device when the lid 130 is in a closed position. The multi-axis mounting 310 further facilitates angular variation in the position of the thermal control element 220 as the lid 130 is lowered towards the surface of the EWOD device when the EWOD device is positioned within the aperture 250. The biasing layer 320 further ensures the surface of the thermal control component 220 is firmly pressed against the outer surface of the upper substrate of the EWOD device to ensure good thermal contact along the length and width of the surface of the EWOD device.

The view of FIG. 6 illustrates the reverse side of the multi-axis mounting 310, particularly showing the portion of bracket 305 that attaches to the lid 130 and the widened portion of multi axis mounting 310. A biasing stopper 313 further may be provided on the lid-side face of the mounting 310, and the biasing stopper 313 further acts to press thermal control component 220 against the upper substrate of the EWOD device when the lid 130 is closed. In particular, the biasing stopper 313 reacts against the underside of lid 130 against which bracket 305 is fixed.

As seen in FIGS. 4 and 5, an end of the optical system 140 may be located at an edge corner of the thermal control component 220, although it will be appreciated that the optical system 140 may be located at any location on the thermal control component 220 that is suitable for optical sensing, or between respective plates of individual thermal control elements 220*a* and 220*b* that is also a suitable location for optical sensing. The optical system 140 permits the measurement of optical characteristics of a sample droplet within the EWOD device when a droplet is moved below the optical system 140. The optical system 140 may be configured to perform a variety of optical measurements, including for example visual, fluorescence, chemiluminescence, absorbance, and reflectance measurements. The optical system may include a fibre optic probe (which may comprise a bundle of fibres) or an optical waveguide, and in an exemplary embodiment the optical system is configured to operate in a reflectance mode, wherein a first optical fibre delivers illuminating light and a second optical fibre receives reflected light. When the thermal control component is in contact with the top substrate of an EWOD device, the fibre optic probe is oriented to make a measurement of a droplet located beneath the fibre optic probe within the cavity of the EWOD device. The optical system may be embedded within the thermal control component, positioned in a gap between two individual thermal control elements of the thermal control component, or in a region away from the thermal control component. The optical system may be configured as a spectrometer, a fluorometer, a digital camera, a CCD array, a CMOS sensor, a photodiode, a photomultiplier (PMT), an avalanche photodiode, a multi pixel photon counter, or like device.

As is known in the art, certain reaction protocols employ sample or reagent droplets that include magnetically responsive particles, whereby droplet behaviour may be influenced by application of a magnetic field. Accordingly, as further depicted in FIGS. 4 and 5, the microfluidic system 100 further may include a magnetic field spreader 300, which in this example is positioned to align with an internal magnetic actuator (shown in figures below) positioned within the housing 110 of the microfluidic system 100. The magnetic field spreader 300 serves to increase the field gradient of an internal magnetic actuator in a lateral direction about the vertical axis between the magnetic actuator and the magnetic field spreader 300. By appropriate selection of material and dimensions of the magnetic field spreader 300, an increase in the magnetic field gradient of at least four-fold is achieved at a distance of about 3 mm in a lateral distance from the tip of the magnetic actuator, as compared to absence of the magnetic field spreader 300.

The magnetic field spreader 300 may be formed using any suitable ferromagnetic material, such as for example martensitic stainless steel (hardened), ferrite (nickel zinc), carbon steel, nickel, martensitic stainless steel (annealed), ferritic stainless steel (annealed), iron (99.8% pure), permalloy, cobalt-iron (high permeability strip material), nanoperm, iron (99.95% pure Fe annealed in H); where such materials have a permeability of at least about 50, at least about 75, at least about 100, at least about 125, at least about 150, at least about 175, at least about 200. Magnetic field spreader 300 may typically have a width dimension of at least about 0.2 mm, at least about 0.5 mm, at least about 0.75 mm, at least about 1 mm, at least about 1.5 mm, at least about 2 mm, at least about 3 mm, at least about 4 mm, at least about 5 mm; a thickness dimension at least about 0.1 mm, at least about 0.2 mm, at least about 0.3 mm, at least about 0.4 mm, at least about 0.5 mm, at least about 0.75 mm, at least about 1 mm, at least about 2 mm, at least about 5 mm; and a length dimension of at least about 2.5 mm, at least about 5 mm, at least about 7.5 mm, at least about 10 mm, at least about 15 mm, at least about 20 mm, at least about 30 mm, at least about 40 mm, at least about 60 mm. One benefit of incorporating the magnetic field spreader 300 is that when the internal magnetic actuator is actuated, the effect of the magnetic field on magnetically responsive particles that may be present within a droplet used in performance of an assay protocol within the EWOD device is measurably enhanced. This permits manipulation of magnetically responsive particles in ways that might not otherwise be possible.

Figure 7:
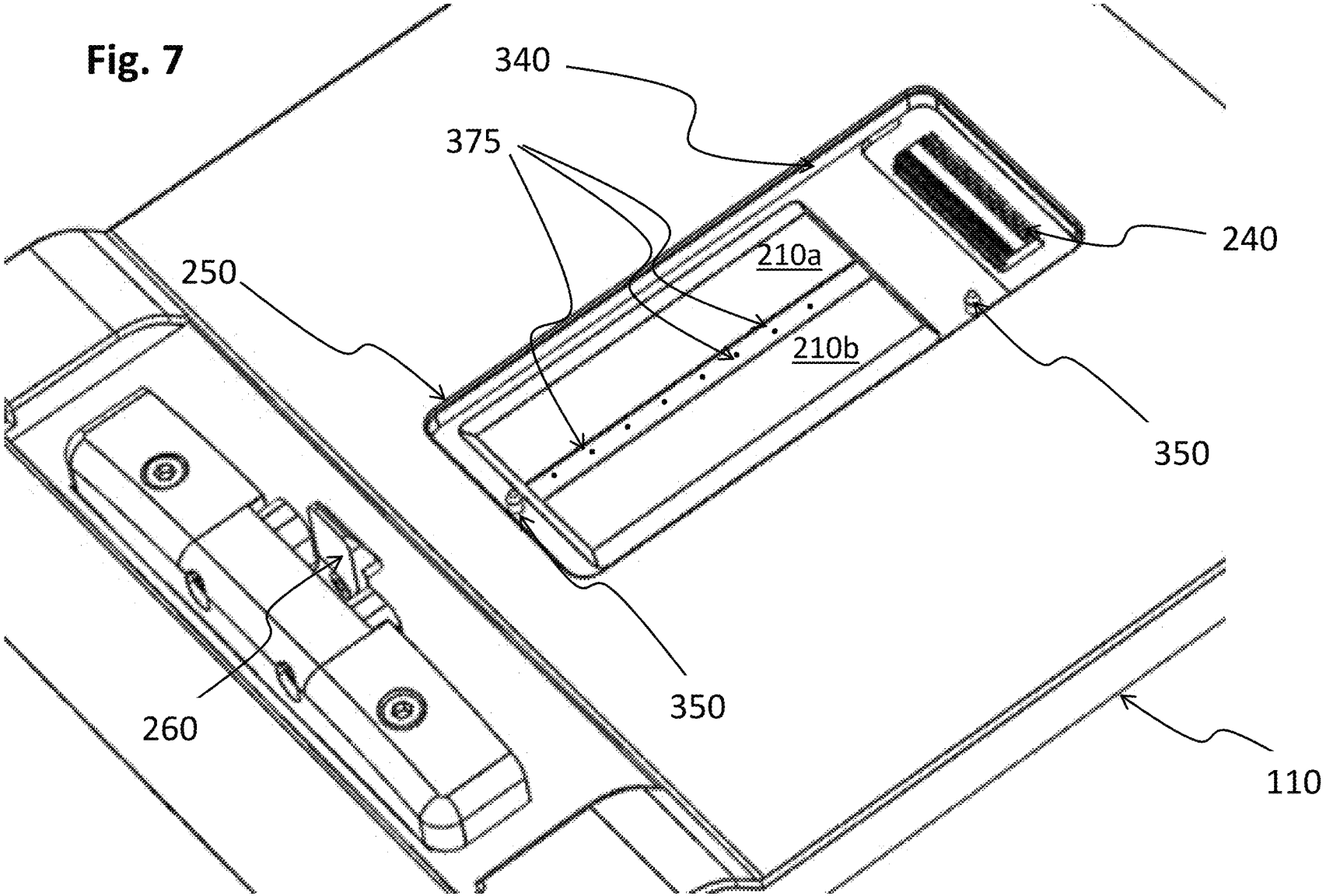
FIG. 7 is a drawing depicting a close-up perspective view of the microfluidic control system in the area of the aperture into which an EWOD device is inserted, with the clamp in the open position.

FIG. 7 is a drawing depicting a close-up perspective view of the microfluidic control system in the area of the aperture 250 into which an EWOD device may be inserted, with the clamp 230 in the open position (and thus not shown in FIG. 7). FIG. 7 illustrates additional details as to the configuration of the active heating component 210. The active heating component 210 is located within the housing 110 at a base of the aperture 250. In exemplary embodiments, the active heating component 210 includes a plurality of independently controllable individual heating elements. In this particular example, active heating component 210 includes two independently controllable individual active heating elements 210*a* and 210*b*. The heating elements 210*a* and 210*b* are configured as dual rectangular active heating elements that run along the longitudinal direction of the housing 110. It will be appreciated that any suitable number and/or shape of individual active elements may be employed. In general, the thermal control component 220 (including the individual thermal control elements) and the active heating component 210 (including the individual heating elements) are configured to align with each other when the lid 130 is closed.

FIG. 7 further depicts the electrical connection 240 referenced above, for connection to cooperating electrical connection components of an inserted EWOD device. For effective positioning of the EWOD device within the aperture 250, the housing 110 may include an indent 340 that is shaped to receive an EWOD device, and one or more locating pins 350 that cooperate with the indent 340 to locate and position the EWOD device.

FIG. 7 further illustrates the positioning of a plurality of magnetic elements 375 that, as referenced above, can generate a magnetic field for acting on magnetically responsive particles located in a droplet within an EWOD device. Any suitable number of magnetic elements may be employed, and there are eight magnetic elements 375 in this particular example. The magnetic elements can be raised and lowered relative to an EWOD device using any suitable actuator, such as for example a stepper motor. When the magnetic elements 375 are in a disengaged position by action of the actuator (e.g., 12 mm below the EWOD device surface), the magnetic elements have no influence on any magnetically responsive particles that are present in a droplet within the EWOD device. When the magnetic elements 375 are in a raised position by action of the actuator, such that tips of the magnetic elements are in line with the surface of the active heating component 210, the magnetic field interacts with magnetic field spreader 300 to enhance the effect of the magnetic field on any magnetically responsive particles that might be present within the EWOD device.

Figure 8:
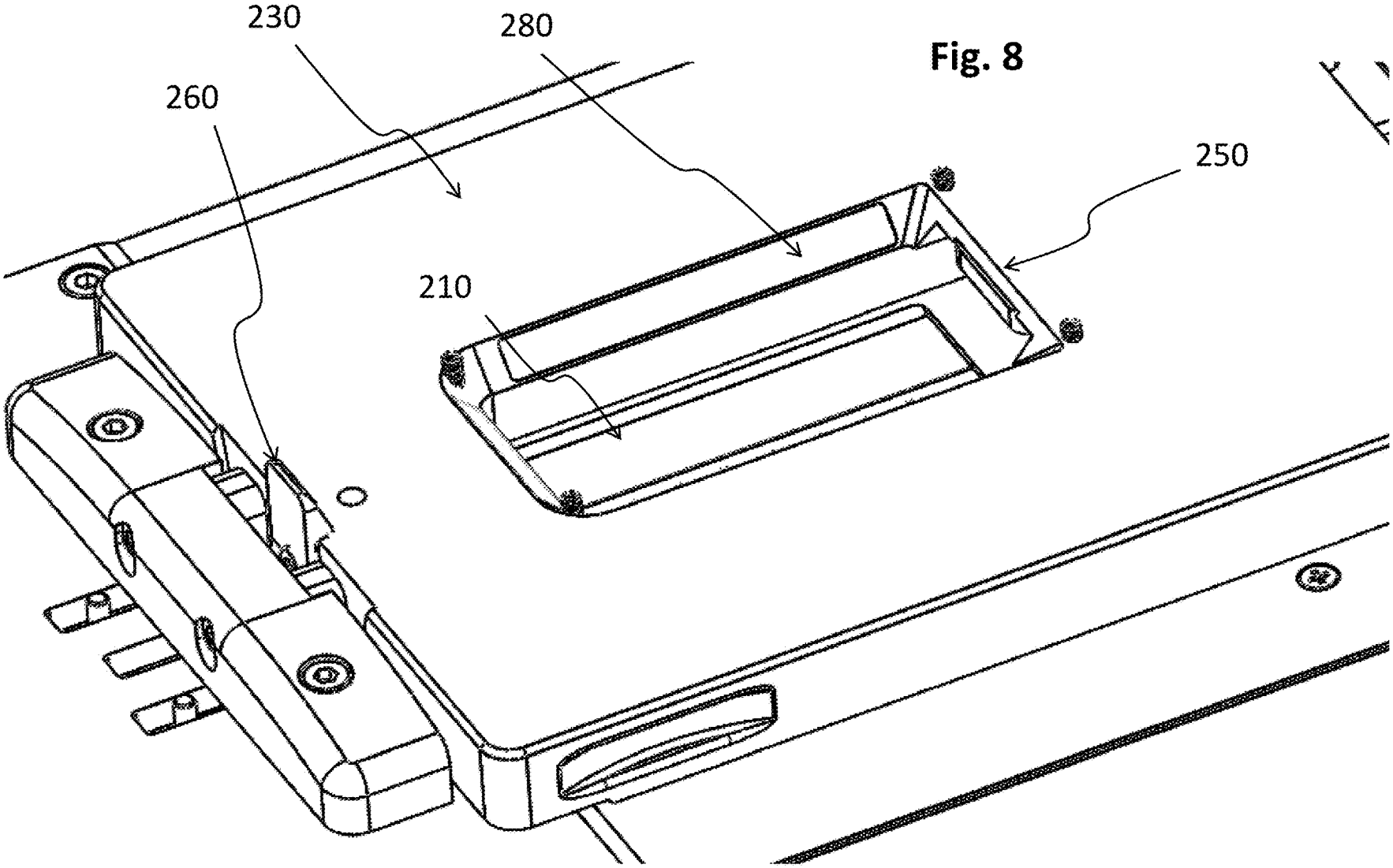
FIG. 8 is a drawing depicting the portion of the microfluidic control system of FIG. 7, with the clamp in the closed position.

FIG. 8 is a drawing depicting the portion of the microfluidic control system of FIG. 7, with the clamp 230 in the closed position. The clamp 230 has an inwardly sloping edge surface 280 that spans around the upper perimeter of the aperture 250, and the sloping edge surface 280 operates to aid a user when introducing fluid samples, using a pipette for example, into a port of an EWOD device. When the clamp 230 is in the closed position, the latch 260 secures the clamp 230 in place, which maintains the EWOD device in a secured position when an EWOD device is inserted into the aperture 250. The latch 260 may be a spring biased mechanical latch element that has a protrusion that is deflected as the clamp 230 is lowered into a closed position, which subsequently returns once the clamp 230 has travelled past the protrusion. The protrusion thus engages the upper surface of the clamp 230, thereby holding the clamp 230 in a closed position. As another configuration, the latch 260 may be provided as an electromagnetic actuator, which may exert a holding force on an appropriately positioned magnetically susceptible material affixed on the underside surface of the clamp 230, such that when the clamp 230 is in a closed position the clamp is held closed by the operation of the magnetic field. Alternatively, the electromagnetic element may be located within the clamp 230 and the magnetically susceptible element may be placed on the surface on the instrument against which the clamp 230 is closed.

Figure 9:
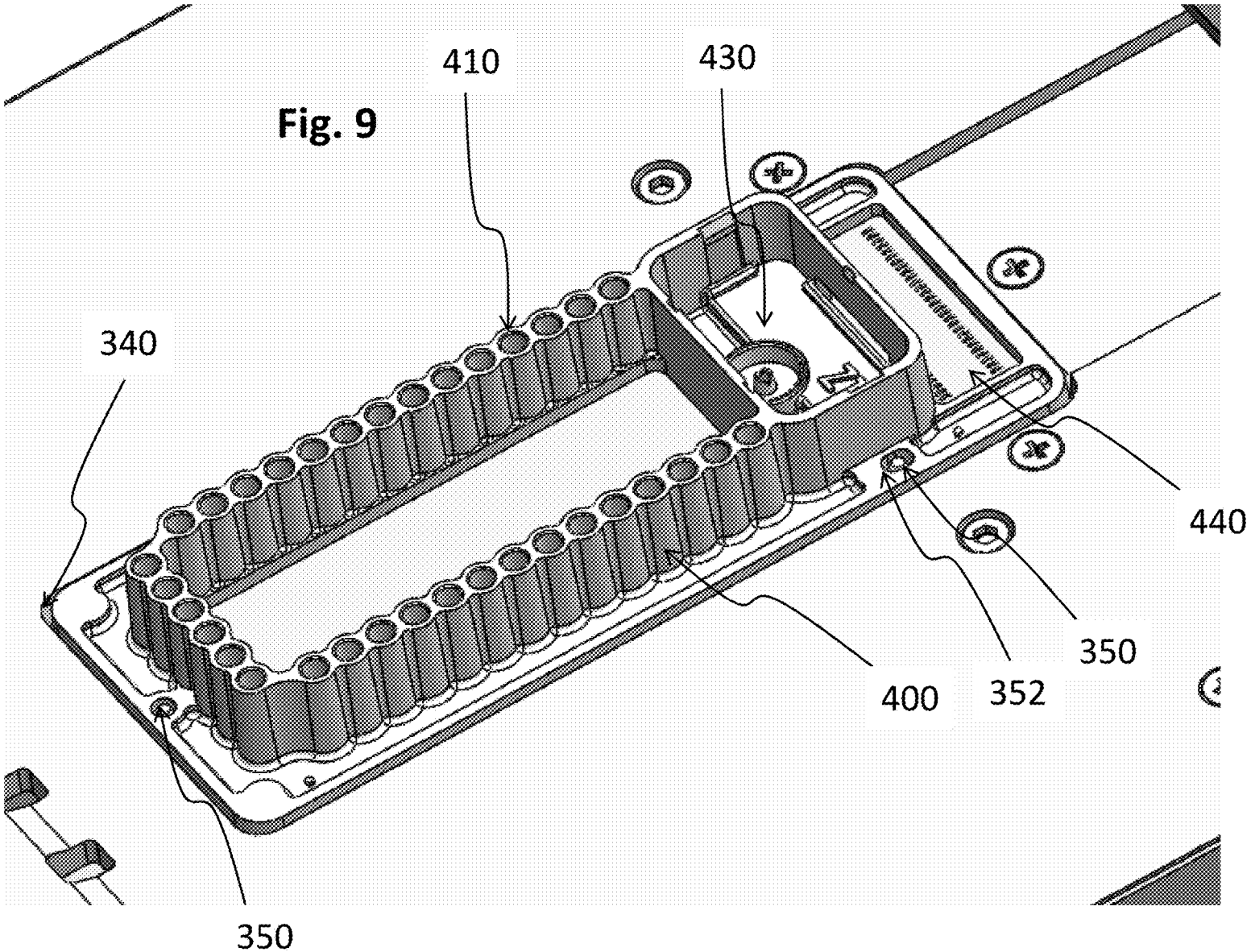
FIG. 9 is a drawing depicting a variation of FIG. 7 in which an EWOD device is positioned within the microfluidic control system.
Figure 10:
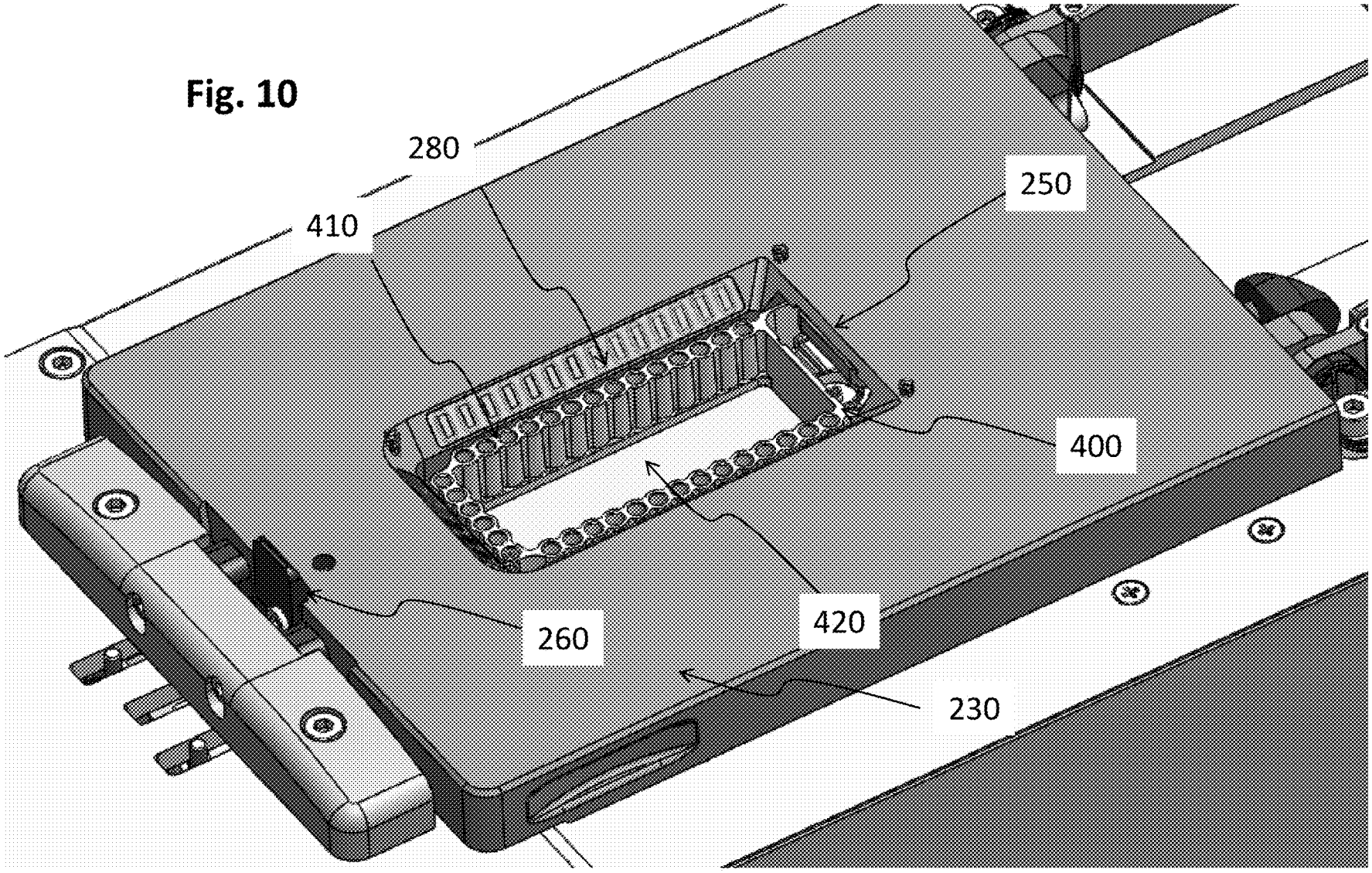
FIG. 10 is a drawing depicting a variation of FIG. 8 in which an EWOD device is positioned within the microfluidic control system.
Figure 11:
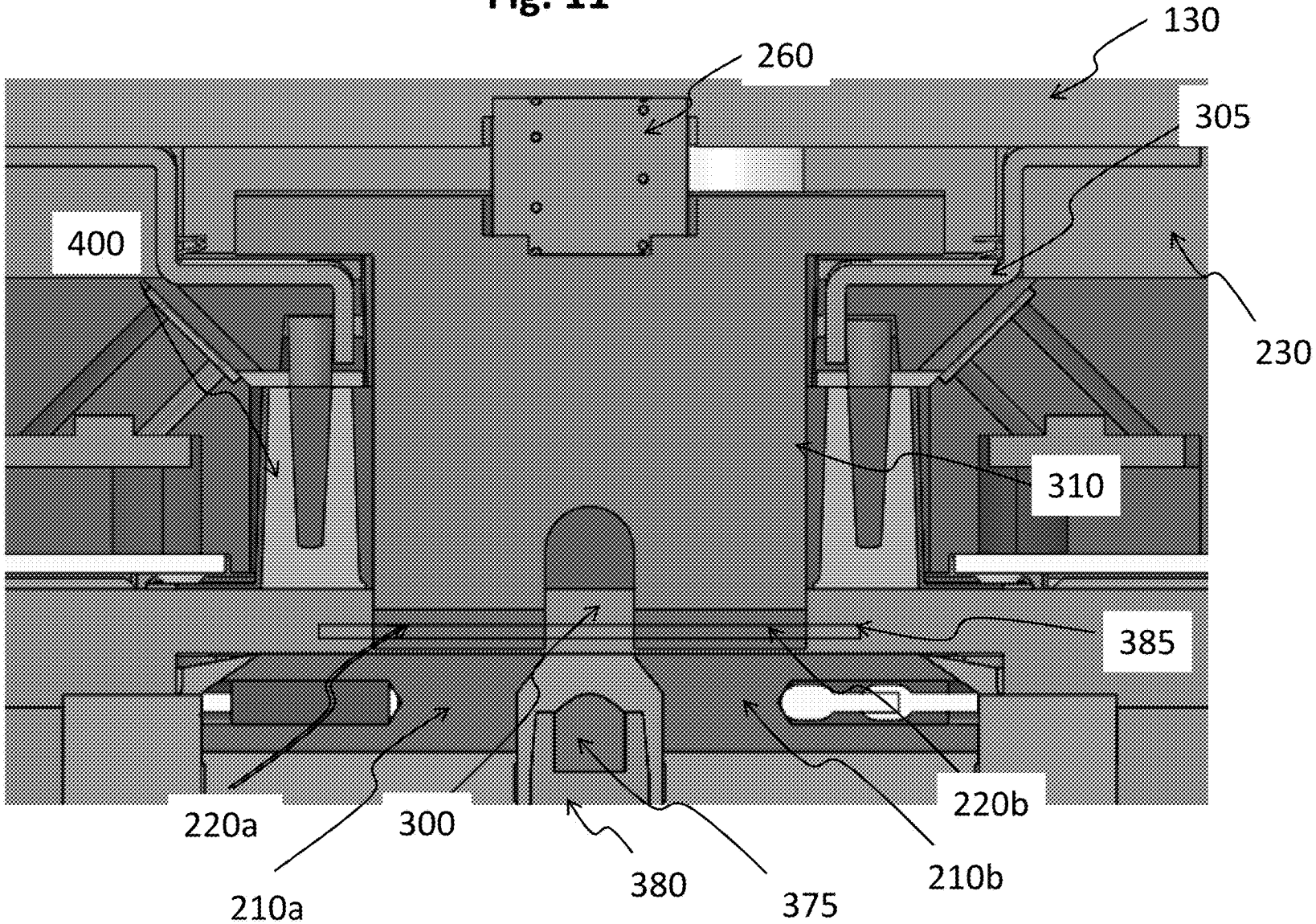
FIG. 11 is a drawing depicting a cross-sectional view of the microfluidic control system and an EWOD device positioned within the microfluidic control system.

FIGS. 9-11 are drawings that depict the microfluidic control system and an EWOD device 400 positioned within the microfluidic control system. In particular, FIGS. 9 and 10 are drawings depicting respective variations of FIGS. 7 and 8 in which an EWOD device 400 is positioned within the microfluidic control system, and FIG. 11 is a drawing depicting a cross-sectional view of the microfluidic control system and the EWOD device positioned within the microfluidic system. The individual heating elements 210*a* and 210*b* can be independently thermally controlled so as to respectively heat or cool a region of the EWOD device immediately in contact with the respective heating element. In use, the individual heating elements 210*a* and 210*b* are aligned directly beneath the individual thermal control elements 220*a* and 220*b* (see, e.g., FIG. 11) of the thermal control component 220, which again is fixed to lid 130 of microfluidic system 100 via the multi-axis mounting 310. Thermal control element 220*a* thus mirrors the thermal profile of active heating element 210*a*, and thermal control element 220*b* mirrors the thermal profile of active heating element 210*b*.

Referring to FIGS. 7 and 9, when the EWOD device 400 is introduced into the microfluidic control system 100, a user is guided to introduce the EWOD device 400 into the indent 340, such that one or more alignment apertures 352 in the base of the EWOD device 400 aligns with a respective locating pin 350. There may be multiple locating pins 350 and corresponding apertures 352 spaced with any suitable configuration to ensure correct alignment of the EWOD device, and with such alignment, an electrical terminal 440 of the EWOD device 400 electrically connects with the electrical connection 240 of the microfluidic control system. The EWOD device 400 further includes a fluid reservoir 430 that may be filled with a filler fluid, such as a non-polar fluid or oil as is known in the art, which is used to fill the portion of the volume of the fluid channel of EWOD device 400 that is not occupied by a sample or reagent fluid.

Referring to FIGS. 8 and 10, the EWOD device 400 is held in place by clamp 230 engaged and secured with the latch 260. The securing of the EWOD device by the latch 260 ensures that the clamp 230 applies a consistent and uniform downward pressure on EWOD device 400. The EWOD device 400 has an array of ports 410 around the perimeter of an upper substrate 420 of the EWOD device, and the ports 410 further are arranged in alignment with a lower edge of sloping edge surface 280 of the clamp 230. A user may thus use sloping edge surface 280 as a guide when introducing fluid samples and reagents into the EWOD device 400 via one or more ports 410, such as by using a pipette or other suitable instrument for fluid introduction.

A series of indicators, such as for example light emitting diodes, may be provided adjacent each port of the EWOD device, which are selectively illuminated to indicate to a user into which port a sample is to be introduced. A user may either utilise a single channel pipette, in which case fluid may be introduced into a particular port in a specific order, according to the order in which the port is illuminated. Alternatively, a user may introduce a sample using a multichannel pipette, in which case all ports may be filled in a single action. In instances in which a single or a multichannel pipette is utilized, a user may be provided with containers containing reagents and/or sample fluids, which may be suitably labelled to indicate which fluid is intended to be introduced into which port of the EWOD device. When a multichannel pipette is used, this may ensure the correct fluid is introduced into the correct port of the EWOD device, since fluids are acquired from a suitable container that has been appropriately filled with fluids in the order in which they are to be applied to the EWOD device.

Referring to FIGS. 7-10 and additionally to the cross-sectional view of FIG. 11, when the lid 130 is closed, the thermal control component 220 (including individual thermal control elements 220*a* and 220*b*) is positioned oppositely relative to the EWOD channel gap 385 from the active heating component 210 (including individual active heating elements 210*a* and 210*b*). In use, active heating component 210 and thermal control component 220 are operated to define discrete thermal zones within the EWOD device 400. A sample droplet may be moved by electrowetting between thermal zones to expose the sample droplet to different temperature conditions. A thermal zone aligned between heating element 210*a* and thermal control element 220*a* may be cycled through a range of temperatures according to the process being performed within the microfluidic system. Similarly, a thermal zone aligned between heating element 210*b* and thermal control element 220*b* may be cycled through a range of temperatures according to the process being performed within the microfluidic system. When more rapid changes in temperature are required for a given process or reaction protocol, different temperature zones may be generated by different zones of heating/control elements 210*a*/220*a* as compared to heating/control elements 210*b*/220*b*, respectively, and droplets may be moved laterally between respective temperature zones. When a rapid change in temperature is not particularly urgent or significant, the set point temperature of active heating elements 210*a* and 210*b* may be modulated to selectively vary the temperature within the channel of EWOD device 400.

The active heating component 210 (including individual active heating element) conducts thermal energy, which may be for either heating or cooling, to (heating) or from (cooling) the lower substrate of EWOD device 400. Thermal energy is transferred into the thermal control component 220 (including individual thermal control elements) through the thickness of the EWOD device channel 385. The thermal control component 220 operates as a heat spreader to maintain a more uniform temperature profile within the channel of the EWOD device that is between respective active heating elements (e.g., 210*a* and/or 210*b*) and thermal control elements (e.g., 220*a* and/or 220*b*) in which assay fluid is present. It has been found that through appropriate selection of materials used to construct thermal control component 220 and configuring the dimensions of the thermal control component and the individual thermal control elements, the thermal control component 220 ensures improved temperature consistency through the volume thickness of the channel of the EWOD device.

When the clamp 230 is lowered to a closed position and locked in place with latch 260, the EWOD device 400 is pressed against active heating component 210 and electrical connection 240 in preparation for performing a reaction process within the EWOD device. The control system electrical connection 240 may include a plurality of resiliently biased contacts that ensure contact with corresponding electrode pins on the underside of EWOD device electrical terminal 440. The integrity of the electrical connection between the EWOD device 400 and electrical connection 240 of microfluidic system 100 ensures accurate operation of the droplet manipulation processes to be performed within the EWOD device. When clamp 230 is lowered to a closed position, the resilient biasing elements 313 and 320 (see FIGS. 5-6) ensure even pressure is applied to EWOD device 400, and in particular as to electrical connector 440, so as to maintain electrical contact with electrical connection 240 and ensure uniform thermal contact between the active heater component 210 and the lower substrate of EWOD device 400.

The electrical connection may be positioned in alternative ways. For example, the electrical connection 240 may be provided on an under-surface of clamp 230, rather than on the surface of the housing within aperture 250. In such a configuration, the electrical connection on EWOD device 400 is provided on the same surface as sample port 410. When an EWOD device 400 is located within aperture 250, an electrical connection is made between EWOD device 400 and electrical connection 240, when clamp 230 is lowered into a closed position. In still further embodiments, the electrical connection between EWOD device 400 and electrical connection 240 may be formed in a plane non-parallel with upper substrate 420 of EWOD device 400. For example, the electrical terminal 440 of EWOD device 400 may be at 90 degrees (either upward or downward) relative to upper substrate 420. Electrical terminal 440 may either be pressed against electrical connection 240, as clamp 230 is lowered to a closed position, or electrical terminal 440 may be inserted into an aperture, similar to a Secure Digital Memory card connector port, which contains a series of spring biased terminals that engage and hold in place electrical terminals on the removable element.

In an exemplary embodiment, the optical system is arranged to acquire measurement information concerning a sample through the upper substrate 420 of EWOD device 400. The optical system also may be arranged to acquire measurement information of a sample directly within a port 410. For example, when making a determination of the protein/nucleic acid composition of a sample using a 260 nm/280 nm ratio, it may be desirable to illuminate the sample directly, in particular in cases in which the upper substrate 420 is not transparent to ultraviolet radiation. In further embodiments, the inner dimensions of a given port 410 may be specifically defined to represent a defined optical path and/or sample volume configuration, which may permit quantitative measurements of sample fluid to be made.

In some configurations, the EWOD device 400 may be provided with a sealed capsule of filler fluid within the fluid reservoir 430. Clamp 230 may include an actuator such that when clamp 230 is moved to a closed position, the clamp 230 applies a actuation force to the sealed capsule so as to cause an aperture to be opened in both the base and top of the capsule, which results in filler fluid to flowing from the capsule under gravitational force into the channel of EWOD device 400. The actuator within clamp 230 that engages fluid reservoir 430 may cause a first opening to be formed in a lower sealing layer of the reservoir, through which oil may flow from the capsule into the EWOD device 400. Once an opening has been formed in a lower sealing layer, a subsequent opening may be formed in an upper sealing layer of the reservoir, thereby allowing pressure within the reservoir to equalise, allowing fluid to flow freely under the influence of gravitational force. Generally, it may not be desirable for fluid to flow from the capsule under compression, since this may lead to undesirable effects. However, in some embodiments it may be required that pressure is used, for example where a fluid that is viscous is used, that would not flow sufficiently freely under the influence of gravitational force. Once the clamp 230 is fully closed and locked, fluid from within the reservoir will have moved into the chamber of the EWOD device prior to a user being instructed to introduce sample fluid through one or more ports using a pipette, as described herein above, for example.

FIG. 11 further illustrates the magnetic field generating components that may be employed for manipulating droplets that have magnetically responsive particles. The magnetic elements 375 are attached to an actuator 380 that may raise and lower the magnetic elements 375 relative to the EWOD device 400. FIG. 11 depicts the magnetic elements 375 in the raised position. When in such raised position, the magnetic elements 375 are positioned oppositely from the magnetic spreader 300, whereby the magnetic spreader distributes the magnetic field across the EWOD device 400 as described above.

Figure 1B:
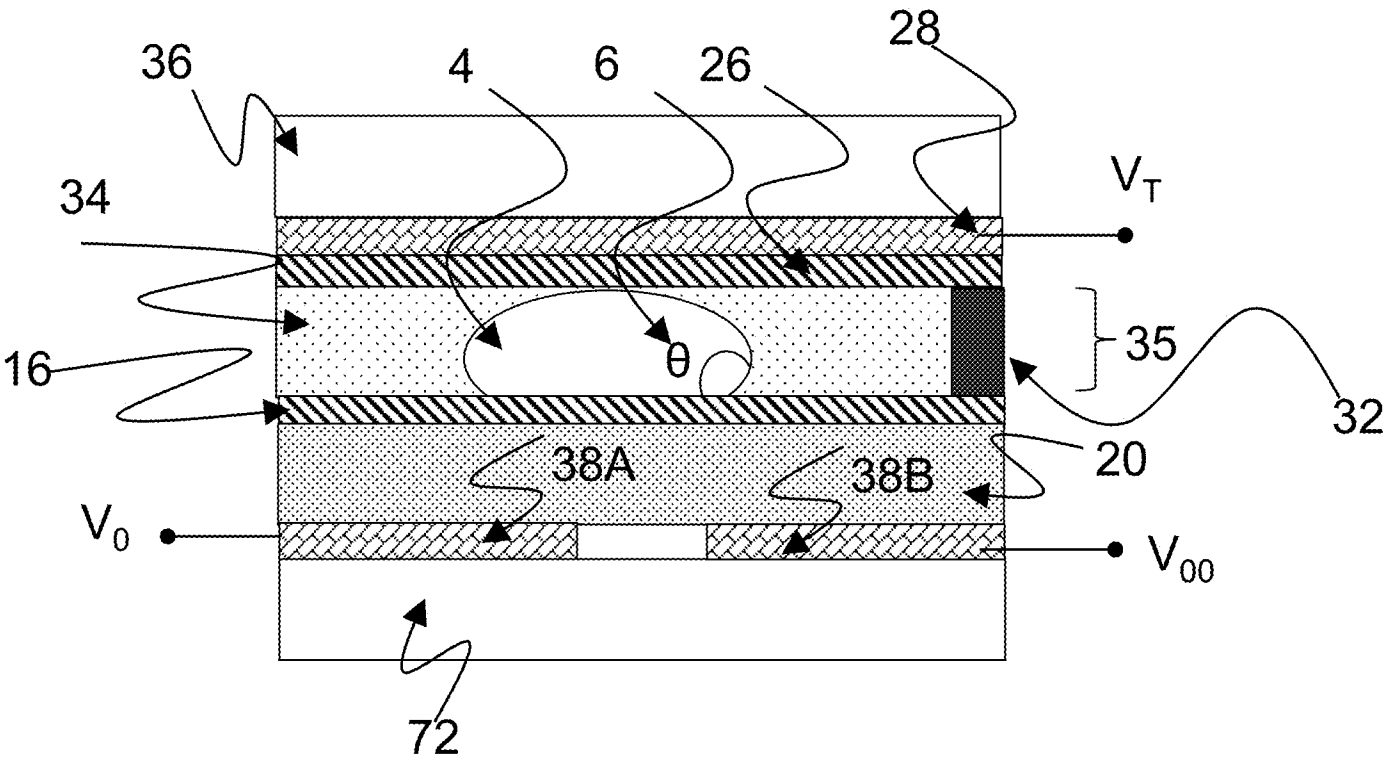
FIG. 1B is a drawing depicting a conventional EWOD device in cross-section.

The EWOD device 400 may be configured comparably to any suitable EWOD device as are known in the art, such as for example as depicted in FIGS. 1A and 1B. Referring back to FIG. 1B, the EWOD device 400 typically may include a lower substrate 72, a top substrate 36 (corresponding for example to element 420 in FIG. 10), a spacer 32, and a filler fluid or non-polar fluid 34 (e.g. an oil) as a surrounding medium within which the liquid droplets 4 are constrained and may be manipulated. In operation the EWOD device is configured to perform droplet manipulation operations in accordance with a sequence of operations as may be warranted for any given reaction protocol or application. The droplet manipulation sequence is executed by selectively actuating the element electrodes 38 to perform multiple droplet operations in series and/or parallel. Typical droplet operations as are well-known in the art may include, for example:

- Moving droplets, such as from one array element to another;
- Mixing droplets together such as by merging and agitation;
- Splitting droplets into two halves;
- Dispensing of a small droplet from a larger reservoir droplet; and
- Inputting droplets onto the element array from large input reservoirs, which may interface the device with the outside world.

Referring back to FIG. 1A, the microfluidic control system 100 of the present application further may include control electronics and an electronic storage device that may store any application software and any data associated with the system, comparably as the control electronics 11 and a storage device 12 illustrated in FIG. 1B. The control electronics and electronic storage device may be incorporated into the housing 110 in any suitable manner, wherein power and control signals are applied by the electronic connection of the connectors 240 and 440. The control electronics may include suitable circuitry and/or processing devices that are configured to carry out various control operations relating to control of the EWOD device 400, such as a CPU, microcontroller or microprocessor. The electronic storage device may be configured as a non-transitory computer readable medium, such as random-access memory (RAM), a read-only memory (ROM), an erasable programmable read-only memory (EPROM or Flash memory), or any other suitable computer-based storage medium.

In accordance with embodiments of the present application, the heating/cooling system for the EWOD device is designed to create distinct thermal zones within the EWOD device. Each thermal zone may have a defined temperature profile. A thermal zone may be heated or cooled relative to ambient temperature to a single constant temperature. Alternatively, a thermal zone may be heated or cooled to produce a gradation of temperature, i.e., a temperature gradient, across the thermal zone.

The upper substrate of the EWOD device and lower substrate of the EWOD device may be made of a material having a relatively low thermal conductivity. A preferred material for the upper substrate and lower substrate may be glass with thermal conductivity 1-2 W/mK. The glass may be of thickness less than 1 mm and may be of a type typically used in the manufacture of liquid crystal displays. Alternatively, the upper substrate and lower substrate may be made from other materials including, but not limited to silica, sapphire and plastics and the like. The low thermal conductivity of such materials is advantageous because these types of materials limit lateral heat flow between adjacent contact regions.

An aspect of the invention, therefore, is a microfluidic control system for controlling an EWOD device, the control system having an enhanced thermal control system for generating a temperature profile within an EWOD device that is inserted into the microfluidic control system. In exemplary embodiments, the microfluidic control system includes a housing that defines an aperture for receiving an EWOD device; an active heating component located within the housing at a base of the aperture; a lid attached to the housing that is moveable between a closed position and an open position, the lid including a thermal control component; and wherein when the lid is in the closed position, the thermal control component is positioned at the aperture and aligned oppositely from the active heating component. The microfluidic control system may include one or more of the following features, either individually or in combination.

In an exemplary embodiment of the microfluidic control system, the active heating component comprises a plurality of independently controllable individual heating elements.

In an exemplary embodiment of the microfluidic control system, the thermal control component comprises a plurality of individual thermal control elements.

In an exemplary embodiment of the microfluidic control system, a number of individual thermal control elements equals a number of individual active heating elements, and when the lid is in the closed position, the individual thermal control elements are respectively aligned with the individual active heating elements.

In an exemplary embodiment of the microfluidic control system, the active heating component comprises a resistive Joule heater, a Peltier-effect based heater and/or cooler, an optical heat generator, a magnetic type heater, and/or a heater or cooler based on convective, conductive or radiative transfer of heat in or out of the active heating component.

In an exemplary embodiment of the microfluidic control system, the thermal control element is a passive component, and the thermal control component is heated by the active heating component.

In an exemplary embodiment of the microfluidic control system, the thermal control component includes copper, aluminium, gold, silver, platinum, steel, sapphire, or diamond.

In an exemplary embodiment of the microfluidic control system, the thermal control component is a second active heating component.

In an exemplary embodiment of the microfluidic control system, the thermal control component comprises a resistive Joule heater, a Peltier-effect based heater and/or cooler, an optical heat generator, a magnetic type heater, and/or a heater or cooler based on convective, conductive or radiative transfer of heat in or out of the active thermal control component.

In an exemplary embodiment of the microfluidic control system, the thermal control component has a width of 1 mm to 20 mm, a length of 1 mm to 100 mm, and/or a thickness of 0.1 mm to 10 mm.

In an exemplary embodiment of the microfluidic control system, the thermal control component has a thermal conductivity of 25 W/m.K to 2000 W/m.K In an exemplary embodiment of the microfluidic control system, when an EWOD device is received within the aperture and the lid is in the closed position, the active heating component is positioned to heat a lower substrate of the EWOD device and the thermal control component is positioned adjacent an upper substrate of the EWOD device.

In an exemplary embodiment of the microfluidic control system, the control system further includes a multi-axis mounting for fixedly attaching the thermal control component to the lid.

In an exemplary embodiment of the microfluidic control system, the multi-axis mounting includes a biasing layer to which the thermal control component is attached.

In an exemplary embodiment of the microfluidic control system, the biasing layer imparts a uniform contact force between the thermal control component and an upper substrate of the EWOD device, when the EWOD device is inserted within the aperture and the lid is in a closed position.

In an exemplary embodiment of the microfluidic control system, the biasing layer comprises a spring, a foam pad, or an elastomeric pad.

In an exemplary embodiment of the microfluidic control system, the control system further includes a bracket that is fastened to an underside of the lid to secure the multi-axis mounting to the lid, wherein the multi-axis mounting extends through an opening defined by the bracket.

In an exemplary embodiment of the microfluidic control system, the multi-axis mounting has a tapered shape that is wider adjacent to the bracket to prevent the multi-axis mounting from passing completely through the bracket.

In an exemplary embodiment of the microfluidic control system, the control system further includes a clamp positioned between the lid and the housing, wherein the clamp is moveable between an open position and a closed position for retaining the EWOD device when the EWOD device is inserted in the aperture and the clamp is in the closed position.

In an exemplary embodiment of the microfluidic control system, when the clamp is in the closed position, the clamp is configured to one or more of: i) press an electrical terminal of the EWOD device to an electrical terminal of the located within the housing; ii) correctly orient the EWOD device within the housing; iii) ensure the EWOD device is held proximate to the active heating component; iv) actuate a reservoir of filler fluid integrated on the EWOD device to cause filling of a channel of the EWOD device with filler fluid; and v) present sample receiving ports to a user.

In an exemplary embodiment of the microfluidic control system, the clamp is configured to be closed prior to closure of the lid.

In an exemplary embodiment of the microfluidic control system, the control system further includes an optical system attached to the lid for determining an optical characteristic of the EWOD device when the EWOD is received within the aperture.

In an exemplary embodiment of the microfluidic control system, the optical system is configured to make a visible measurement and/or a fluorescence measurement.

In an exemplary embodiment of the microfluidic control system, the optical system comprises a fibre optic probe or an optical waveguide.

In an exemplary embodiment of the microfluidic control system, when the thermal control component is in contact with a top substrate of an EWOD device, the fibre optic probe or the optical waveguide is oriented to make a measurement of a droplet located beneath the fibre optic probe or the optical waveguide within a channel or a port of the EWOD device.

In an exemplary embodiment of the microfluidic control system, when the optical system is configured to operate in a reflectance mode, a first optical fibre delivers illuminating light and a second optical fibre receives reflected light, or an optical waveguide delivers and receives light in combination with a dichroic mirror.

In an exemplary embodiment of the microfluidic control system, the optical system is embedded within the thermal control component.

In an exemplary embodiment of the microfluidic control system, the optical system is positioned in a gap between two individual thermal control elements of the thermal control component.

In an exemplary embodiment of the microfluidic control system, the optical system is positioned in a region away from the thermal control component.

In an exemplary embodiment of the microfluidic control system, the optical system comprises a spectrometer, a fluorometer, a digital camera, a CCD array, a CMOS sensor, a photodiode, a photomultiplier (PMT), an avalanche photodiode, or a multi pixel photon counter.

In an exemplary embodiment of the microfluidic control system, the lid further includes a magnetic field spreader.

In an exemplary embodiment of the microfluidic control system, the magnetic field spreader is a passive element.

In an exemplary embodiment of the microfluidic control system, the magnetic field spreader has a permeability of 50 to 200.

In an exemplary embodiment of the microfluidic control system, the magnetic field spreader comprises a hardened or annealed martensitic stainless steel, ferrite, carbon steel, nickel, ferritic stainless steel, iron, permalloy, cobalt-iron, and/or nanoperm.

In an exemplary embodiment of the microfluidic control system, the magnetic field spreader has a length of 2.5 mm to 60 mm, a width of 0.2 mm to 5 mm, and/or a thickness of 0.1 mm to 5 mm.

In an exemplary embodiment of the microfluidic control system, the magnetic field spreader is located in proximity of the thermal control component and attached to a multi-axis mounting that fixes the thermal control component to the lid.

In an exemplary embodiment of the microfluidic control system, the control system further includes control electronics and an electronic storage device located within the housing for controlling the operation of the EWOD device.

In an exemplary embodiment of the microfluidic control system, the control system further includes a user interface for receiving user inputs and displaying information regarding operation of the microfluidic control system and/or the EWOD device.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

Embodiments of the present application may be used to provide enhanced operation of an EWOD device. The EWOD device could form a part of a lab-on-a-chip system. Such devices could be used in manipulating, reacting and sensing chemical, biochemical or physiological materials. Applications include healthcare diagnostic testing, material testing, chemical or biochemical material synthesis, proteomics, tools for research in life sciences and forensic science.

DESCRIPTION OF REFERENCE NUMERALS

4—liquid droplet
6—contact angle
8—reader
9—cartridge
10—AM-EWOD device
11—control electronics
12—storage device
13—external sensor module
16—first hydrophobic coating
20—insulator layer
26—second hydrophobic coating
28—reference electrode
32—spacer
34—non-polar fluid
36—top substrate
38—electrodes
38A—first element electrode
38B—second element electrode
72—lower substrate
100—microfluidic control system
110—housing
120—user interface
130—lid
140—optical system
210—active heating component (includes individual heating elements 210*a*, 210*b*)
220—thermal control component (includes individual thermal control elements 220*a*, 220*b*)
230—clamp
240—electrical connection
250—aperture
260—latch
280—sloping edge surface
300—magnetic field spreader
305—bracket
310—multi-axis mounting
313—biasing stopper
320—biasing layer
333—flanges
340—indent
350—alignment pin
352—alignment aperture
375—magnetic element
380—actuator for magnetic elements
385—EWOD channel gap
400—EWOD device
410—fluid port of EWOD device
420—upper substrate of EWOD device
430—fluid reservoir
440—electrical terminal

The invention claimed is:

1. A microfluidic control system for controlling an electrowetting on dielectric (EWOD) device, the microfluidic control system comprising:

a housing that defines an aperture for receiving an EWOD device;

an active heating component located within the housing at a base of the aperture;

a lid attached to the housing that is moveable between a closed position and an open position, the lid including a thermal control component;

wherein when the lid is in the closed position, the thermal control component is positioned at the aperture and aligned oppositely from the active heating component, and the thermal control component is made of a thermal conductive material, and is configured to act as a heat spreader, which is configured to spread heat from the active heating component to generate a temperature profile.

2. The microfluidic control system of claim 1, wherein the active heating component comprises a plurality of independently controllable individual heating elements.

3. The microfluidic control system of claim 1, wherein the thermal control component comprises a plurality of individual thermal control elements.

4. The microfluidic control system of claim 3, wherein a number of individual thermal control elements equals a number of individual active heating elements, and when the lid is in the closed position, the individual thermal control elements are respectively aligned with the individual active heating elements.

5. The microfluidic control system of claim 1, wherein the thermal control component is a passive component, and the thermal control component is heated by the active heating component.

6. The microfluidic control system of claim 1, wherein when an EWOD device is received within the aperture and the lid is in the closed position, the active heating component is positioned to heat a lower substrate of the EWOD device and the thermal control component is positioned adjacent an upper substrate of the EWOD device.

7. The microfluidic control system of claim 1, further comprising a multi-axis mounting for fixedly attaching the thermal control component to the lid.

8. The microfluidic control system of claim 7, wherein the multi-axis mounting includes a biasing layer to which the thermal control component is attached.

9. The microfluidic control system of claim 8, wherein the biasing layer imparts a uniform contact force between the thermal control component and an upper substrate of the EWOD device, when the EWOD device is inserted within the aperture and the lid is in a closed position.

10. The microfluidic control system of claim 8, wherein the biasing layer comprises a spring, a foam pad, or an elastomeric pad.

11. The microfluidic control system of claim 7, further comprising a bracket that is fastened to an underside of the lid to secure the multi-axis mounting to the lid, wherein the multi-axis mounting extends through an opening defined by the bracket.

12. The microfluidic control system of claim 11, wherein the multi-axis mounting has a tapered shape that is wider adjacent to the bracket to prevent the multi-axis mounting from passing completely through the bracket.

13. The microfluidic control system of claim 1, further comprising a clamp positioned between the lid and the housing, wherein the clamp is moveable between an open position and a closed position for retaining the EWOD device when the EWOD device is inserted in the aperture and the clamp is in the closed position.

14. The microfluidic control system of claim 13, wherein when the clamp is in the closed position, the clamp is configured to one or more of: i) press an electrical terminal of the EWOD device to an electrical terminal of the control system the located within the housing; ii) correctly orient the EWOD device within the housing; iii) ensure the EWOD device is held proximate to the active heating component; iv) actuate a reservoir of filler fluid integrated on the EWOD device to cause filling of a channel of the EWOD device with filler fluid; and v) present sample receiving ports to a user.

15. The microfluidic control system of claim 1, further comprising an optical system attached to the lid for determining an optical characteristic of the EWOD device when the EWOD is received within the aperture.

16. The microfluidic control system of claim 15, wherein the optical system is positioned in a region away from the thermal control component.

17. The microfluidic control system of claim 1, wherein the lid further includes a magnetic field spreader.

18. The microfluidic control system of claim 17, wherein the magnetic field spreader is located in proximity of the thermal control component and attached to a multi-axis mounting that fixes the thermal control component to the lid.

* * * * *